US008536108B2

(12) United States Patent
Panandiker et al.

(10) Patent No.: US 8,536,108 B2
(45) Date of Patent: Sep. 17, 2013

(54) CARE POLYMERS

(75) Inventors: Rajan Keshav Panandiker, West Chester, OH (US); Julie Ann Menkhaus, Cleves, OH (US); Dieter Boeckh, Limburgerhof (DE); Rainer Dobrawa, Stuttgart (DE); Frank Huelskoetter, Bad Duerkheim (DE); Valentin Cepus, Glashuetten (DE); Jack Tinsley, Mannheim (DE); Klaus Muehlbach, Gruenstadt (DE); Markus Brym, Mannheim (DE); Sophia Ebert, Mannheim (DE); Ivette Garcia Castro, Ludwigshafen (DE)

(73) Assignee: The Procter & Gamble Company, Cincinnati, OH (US)

( * ) Notice: Subject to any disclaimer, the term of this patent is extended or adjusted under 35 U.S.C. 154(b) by 15 days.

(21) Appl. No.: 13/105,201

(22) Filed: May 11, 2011

(65) Prior Publication Data

US 2011/0281782 A1 Nov. 17, 2011

Related U.S. Application Data

(60) Provisional application No. 61/333,782, filed on May 12, 2010, provisional application No. 61/333,784, filed on May 12, 2010.

(51) Int. Cl.

| | |
|---|---|
| ***B08B 3/04*** | (2006.01) |
| ***C11D 1/00*** | (2006.01) |
| ***C11D 3/18*** | (2006.01) |

(52) U.S. Cl.
USPC ..... 510/342; 510/276; 510/353; 510/417; 510/437; 510/475; 510/505; 8/137

(58) Field of Classification Search
USPC ..... 510/276, 342, 353, 417, 437, 475, 510/505; 8/137
See application file for complete search history.

(56) References Cited

U.S. PATENT DOCUMENTS

| | | | | |
|---|---|---|---|---|
| 3,645,904 | A | 2/1972 | Beach | |
| 3,790,488 | A | 2/1974 | Iino | |
| 4,566,980 | A | 1/1986 | Smith | |
| 5,198,292 | A | 3/1993 | Lerner et al. | |
| 5,872,149 | A | 2/1999 | Dralle-Voss et al. | |
| 6,102,973 | A | 8/2000 | Morales | |
| 6,780,828 | B2 | 8/2004 | Nagy et al. | |
| 7,214,652 | B1 | 5/2007 | Jariwala | |
| 2003/0166495 | A1 | 9/2003 | Wang et al. | |
| 2005/0075261 | A1 | 4/2005 | Baeck et al. | |
| 2007/0167346 | A1 | 7/2007 | Creutz et al. | |
| 2008/0199420 | A1 * | 8/2008 | Wendel et al. | 424/78.02 |
| 2008/0221257 | A1 * | 9/2008 | Becker et al. | 524/515 |
| 2008/0250701 | A1 * | 10/2008 | Van De Berg et al. | 44/301 |
| 2008/0274073 | A1 | 11/2008 | Bell et al. | |
| 2010/0190679 | A1 * | 7/2010 | Vanpachtenbeke et al. | 510/347 |
| 2011/0281782 | A1 | 11/2011 | Panandiker et al. | |

FOREIGN PATENT DOCUMENTS

| | | | |
|---|---|---|---|
| DE | 19818983 | A1 | 11/1998 |
| EP | 1180362 | A2 | 2/2002 |
| EP | 1913078 | A1 | 4/2008 |
| WO | WO 97/28239 | A1 | 8/1997 |
| WO | WO 03/074644 | A1 | 9/2003 |

OTHER PUBLICATIONS

International Search Report; International Application No. PCT/US2011/036089; date of mailing Aug. 18, 2011; 4 pages.

Heusch, R., "Ullmann's Encyclopedia of Industrial Chemistry", Chapter "Emulsions", 1-47, Wiley-VCH, 2000 (DOI: 10.1002/14356007.a09_297), 2012.

Kostansek, E., "Kirk-Othmer Encyclopedia of Chemical Technology", vol. 10, 113-133, Chapter "Emulsions", John Wiley & Sons 2003 (DOI: 10.1002/0471238961.0513211206180902.a1.pub2).

"Kirk-Othmer Encyclopedia of Chemical Technology"; entries starting with the letter "A"; Emulsions; Emulsification; pp. 731-732; delivered via Infotrieve and the Virtual Library at Procter & Gamble.

* cited by examiner

*Primary Examiner* — Brian P Mruk

(74) *Attorney, Agent, or Firm* — James F. McBride; Steven W. Miller

(57) ABSTRACT

The present application relates to care polymers and fabric and home care compositions comprising such care polymers, as well as processes for making and using such care polymers and such compositions. The performance of the care polymers that Applicants teach, can be further increased by following the emulsification teaching of the present specification and/or combining such care polymers with silicone materials.

11 Claims, No Drawings

CARE POLYMERS

CROSS-REFERENCES TO RELATED APPLICATIONS

This application claims priority under 35 U.S.C. §119(e) to U.S. Provisional Application Ser. No. 61/333,782 filed May 12, 2010; and U.S. Provisional Application Ser. No. 61/333,784 filed May 12, 2010.

FIELD OF INVENTION

The present application relates to care polymers and fabric and home care compositions comprising such care polymers, as well as processes for making and using such care polymers and such compositions.

BACKGROUND OF THE INVENTION

Care polymers, including silicones, are used in premium consumer products to provide benefits such as softness, hand, anti-wrinkle, hair conditioning/frizz control, color protection, etc. Unfortunately, such care polymers are incompatible with a variety of other consumer product ingredients, for example, anionic surfactants, and/or are expensive due to the cost of silicone raw materials and the silicone emulsification step that is required to make such silicones useful in products. Thus, what is needed is an economical, stable care polymer technology with reduced incompatibility issues.

Fortunately, Applicants recognized that the source of the incompatibility and stability issues was the care polymers' charge and such polymers' stiffness as due to such polymers' high glass transition temperature. Thus, Applicants discovered that by judiciously selecting or synthesizing nonionic care polymers that have the correct glass transition temperature, the incompatibility and stability issues could be resolved and yet the required performance can be obtained. The performance of the care polymers that Applicants teach, can be further increased by following the emulsification teachings of the present specification and/or by combining such care polymers with silicone materials.

SUMMARY OF THE INVENTION

The present application relates to care polymers and fabric and home care compositions such care polymers, as well as processes for making and using such care polymers and such compositions.

DETAILED DESCRIPTION OF THE INVENTION

Definitions

As used herein, the term "fabric and home care composition" includes, unless otherwise indicated, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, car or carpet shampoos, bathroom cleaners including toilet bowl cleaners; and metal cleaners, fabric conditioning products including softening and/or freshening that may be in liquid, solid and/or dryer sheet form; as well as cleaning auxiliaries such as bleach additives and "stain-stick" or pretreat types, substrate-laden products such as dryer added sheets, dry and wetted wipes and pads, nonwoven substrates, and sponges; as well as sprays and mists. All of such products which were applicable may be in standard, concentrated or even highly concentrated form even to the extent that such products may in certain aspect be non-aqueous.

As used herein, articles such as "a" and "an" when used in a claim, are understood to mean one or more of what is claimed or described.

As used herein, the terms "include", "includes" and "including" are meant to be non-limiting.

As used herein, the term "solid" includes granular, powder, bar and tablet product forms.

As used herein, the term "fluid" includes liquid, gel, paste and gas product forms.

As used herein, the term "situs" includes paper products, fabrics, garments, and hard surfaces.

Unless specified otherwise, all molecular weights are given in Daltons.

As used herein, "substituted" means that the organic composition or radical to which the term is applied is:

(a) made unsaturated by the elimination of elements or radical; or (b) at least one hydrogen in the compound or radical is replaced with a moiety containing one or more (i) carbon, (ii) oxygen, (iii) sulfur, (iv) nitrogen or (v) halogen atoms; or (c) both (a) and (b).

Moieties that may replace hydrogen as described in (b) immediately above, which contain only carbon and hydrogen atoms are all hydrocarbon moieties including, but not limited to, alkyl, alkenyl, alkynyl, alkyldienyl, cycloalkyl, phenyl, alkyl phenyl, naphthyl, anthryl, phenanthryl, fluoryl, steroid groups, and combinations of these groups with each other and with polyvalent hydrocarbon groups such as alkylene, alkylidene and alkylidyne groups. Specific non-limiting examples of such groups are:

$$-CH_3,\quad -CHCH_3CH_3-(CH_2)_8CH_3,\quad -CH_2-C\equiv CH,$$
$$-CH=CH-CH=CH_2,\quad -HC-(CH_2)_4-CH_2,$$
$$-\phi CH_3,\quad -\phi CH_2\phi,\quad -\phi,\ \text{and}\ -\phi-\phi.$$

Moieties containing oxygen atoms that may replace hydrogen as described in (b) immediately above include hydroxy, acyl or keto, ether, epoxy, carboxy, and ester containing groups. Specific non-limiting examples of such oxygen containing groups are:

$$-CH_2OH,\quad -CCH_3CH_3OH,\quad -CH_2COOH,$$
$$-C(O)-(CH_2)_8CH_3,\quad -OCH_2CH_3,\quad =O,\quad -OH,$$
$$-CH_2-O-CH_2CH_3,\quad -CH_2-O-(CH_2)_2-OH,$$
$$-CH_2CH_2COOH,\quad -\phi OH,\quad -\phi OCH_2CH_3,\quad -\phi CH_2OH,$$
$$-CH_2CH-CH_2\ (\text{epoxide O}),\ \text{and}\ -C=CHCH=CH-O.$$

Moieties containing sulfur atoms that may replace hydrogen as described in (b) immediately above include the sulfur-containing acids and acid ester groups, thioether groups, mercapto groups and thioketo groups. Specific non-limiting examples of such sulfur containing groups are:

$$-SCH_2CH_3,\quad -CH_2S(CH_2)_4CH_3,\quad -SO_3CH_2CH_3,$$
$$-SO_2CH_2CH_3,\quad -CH_2COSH,\quad -SH,\quad -CH_2SCO,$$
$$-CH_2C(S)CH_2CH_3,\quad -SO_3H,\quad -O(CH_2)_2C(S)CH_3,$$
$$=S,\ \text{and}\ \underbrace{-C=CHCH=CH-}S.$$

Moieties containing nitrogen atoms that may replace hydrogen as described in (b) immediately above include amino groups, the nitro group, azo groups, ammonium groups, amide groups, azido groups, isocyanate groups, cyano groups and nitrile groups. Specific non-limiting examples of such nitrogen containing groups are: $-NHCH_3$, $-NH_2$, $-NH_3^+$, $-CH_2CONH_2$, $-CH_2CON_3$, $-CH_2CH_2CH{=}NOH$, $-CAN$, $-CH(CH_3)CH_2NCO$, $-CH_2NCO$, $-N\phi$, $-\phi N{=}N\phi OH$, and $\equiv N$.

Moieties containing halogen atoms that may replace hydrogen as described in (b) immediately above include chloro, bromo, fluoro, iodo groups and any of the moieties previously described where a hydrogen or a pendant alkyl group is substituted by a halo group to form a stable substituted moiety. Specific non-limiting examples of such halogen containing groups are: $-(CH_2)_3COCl$, $-\phi F_5$, $-\phi Cl$, $-CF_3$, and $-CH_2\phi Br$.

It is understood that any of the above moieties that may replace hydrogen as described in (b) can be substituted into each other in either a monovalent substitution or by loss of hydrogen in a polyvalent substitution to form another monovalent moiety that can replace hydrogen in the organic compound or radical.

As used herein "$\phi$" represents a phenyl ring.

As used herein non-ionic care polymer means a polymer with a cationic or anionic charge density of between 0 to about 0.5 milliequivalents/g of net cationic or anionic charge.

Unless specified otherwise, all molecular weights are weight average molecular weights as determined by size exclusion chromatography with a MALS detector.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Useful Emulsions

Polyolefines and in particular polyisobutene(s) are useful ingredients in a lot of technical applications. It is, however, still difficult to obtain stable emulsions comprising such polyolefine(s) and water. There is always a need to add either surfactant or huge amounts of additional polymer, see e.g. U.S. Pat. No. 5,872,149, and Published USPAs 2008/0221257 A1, 2008/0199420 A1 and 2008/0274073 A1.

Therefore an emulsion containing polyolefine(s) and water, which is stable is required. Useful and surprisingly stable emulsions and processes of making such emulsions are described herein.

In one aspect, an emulsion comprising a) polyolefine(s) in an amount of from 2 to 75 mass %,
b) polymer(s) $P_x$ in an amount of from 0.05 to 40 mass %,
c) oil(s) $O_x$ in an amount of from 0 to 25 mass %,
d) surfactant(s) $S_x$ in an amount of from 0 to 25 mass %,
e) additive(s) $A_x$ in an amount of from 0 to 20 mass % and
f) water in an amount of from 10 to 97.95 mass %, based on the total mass of the emulsion, is disclosed.

The emulsion can consist of components a), b) and f), in which case the amounts add up to 100 mass %,—such an emulsion forms a preferred embodiment of the present invention. The emulsion can also contain components a), b) and f) as well as additional components. Emulsions, which in addition to components a), b) and f) also contain components c) and/or d) and/or e) form one preferred embodiment of the invention. The inventive emulsion may also contain other components.

With regard to the amounts, in which the respective compounds are present in the emulsion there exist preferred ranges. Thus an emulsion according to the invention, wherein the components independently of each other are present in amounts of:

a) polyolefin (s) in an amount of from 5 to 50 mass %,
b) polymer(s) $P_x$ in an amount of from 0.5 to 30 mass %,
c) oil(s) $O_x$ in an amount of from 0.1 to 25 mass %,
d) surfactant(s) $S_x$ in an amount of from 0.1 to 20 mass %,
e) additive(s) $A_x$ in an amount of from 0.1 to 15 mass % ad
f) water in an amount of from 30 to 90 mass %, based on the total mass of the emulsion, forms a preferred embodiment of the present invention.

Even more preferred is an emulsion, wherein the components independently of each other are present in amounts of:

a) polyolefine(s) in an amount of from 10 to 40 mass %,
b) polymer(s) $P_x$ in an amount of from 0.5 to 15 mass %,
c) oil(s) $O_x$ in an amount of from 5 to 20 mass %,
d) surfactant(s) $S_x$ in an amount of from 0.1 to 15 mass %,
e) additive(s) $A_x$ in an amount of from 1 to 10 mass % ad
f) water in an amount of from 40 to 85 mass %, based on the total mass of the emulsion.

And most preferred is an emulsion, wherein the components independently of each other are present in amounts of:

a) polyolefine(s) in an amount of from 15 to 30 mass %,
b) polymer(s) $P_x$ in an amount of from 0.5 to 5 mass %,
c) oil(s) $O_x$ in an amount of from 10 to 20 mass %,
d) surfactant(s) $S_x$ in an amount of from 0.5 to 10 mass %,
e) additive(s) $A_x$ in an amount of from 2 to 8 mass % and
f) water in an amount of from 50 to 80 mass %, based on the total mass of the emulsion.

To maximize the content of polyolefine(s), it is advantageous to reduce the amount of other components in the emulsion. Therefore, further preferred emulsions are those, which comprise:

a) polyolefine(s) in an amount of from 15 to 35 mass %,
b) polymer(s) $P_x$ in an amount of from 0.5 to 10 mass %,
c) oil(s) $O_x$ in an amount of 0 mass %,
d) surfactant(s) $S_x$ in an amount of from 4 to 12 mass %,
e) additive(s) $A_x$ in an amount of from 0 to 10 mass % and
f) water in an amount of from 33 to 80.5 mass %, based on the total mass of the emulsion, or a) polyolefine(s) in an amount of from 15 to 35 mass %,
b) polymer(s) $P_x$ in an amount of from 0.5 to 10 mass %,
c) oil(s) $O_x$ in an amount of 10 to 20 mass %, d) surfactant(s) $S_x$ in an amount of from 4 to 12 mass %,
e) additive(s) $A_x$ in an amount of 0 mass % and
f) water in an amount of from 33 to 80.5 mass %,
based on the total mass of the emulsion, or
a) polyolefine(s) in an amount of from 15 to 35 mass %,
b) polymer(s) $P_x$ in an amount of from 0.5 to 10 mass %,
c) oil(s) $O_x$ in an amount of 0 mass %,
d) surfactant(s) $S_x$ in an amount of from 4 to 12 mass %,
e) additive(s) $A_x$ in an amount of 0 mass % and
f) water in an amount of from 33 to 80.5 mass %,
based on the total mass of the emulsion, or
a) polyolefine(s) in an amount of from 15 to 30 mass %,
b) polymer(s) $P_x$ in an amount of from 0.5 to 30 mass %,
c) oil(s) $O_x$ in an amount of from 10 to 20 mass %,
d) surfactant(s) $S_x$ in an amount of 0 mass %,
e) additive(s) $A_x$ in an amount of from 2 to 8 mass % and
f) water in an amount of from 50 to 80 mass %,
based on the total mass of the emulsion
or
a) polyolefine(s) in an amount of from 15 to 30 mass %,
b) polymer(s) $P_x$ in an amount of from 0.5 to 5 mass %,
c) oil(s) $O_x$ in an amount of 0 mass %,
d) surfactant(s) $S_x$ in an amount of 0 mass %,
e) additive(s) $A_x$ in an amount of 0 mass % and
f) water in an amount of from 50 to 80 mass %,
based on the total mass of the emulsion.

Not only the amount but also the nature of the components of the inventive emulsion can be chosen advantageously:

In general polyolefine(s) as used in the present invention is/are a chemical compound(s) consisting of carbon and hydrogen atoms. The polyolefine(s) can be linear, e.g. polyethylene, or can have side chains, e.g. polypropylene having methyl-side chains, which side chains may be that long that comb-like structures are found, or can be co- or ter-polymers, e.g. ethene/propene-copolymer or ethane/propene/hexane-terpolymer. It is particularly preferred, when the polyolefine(s) is/are substantially homopolymers, i.e. the degree of co- or ter-monomer is below 10 mass %, preferably below 5 mass % based on the mass of the polymer. It is particularly preferred, if the polymer(s) is/are homopolymers, i.e. they consist of only one kind of monomer. In particular an emulsion, wherein the polyolefine(s) a) is/are selected from the group consisting of: polyethylene, polypropylene, polybutylene and polyisobutylene is preferred. The emulsion can comprise one or more polyolefine. An emulsion, which only comprises one polyolefine a) is preferred. An emulsion, which only comprises polyisobutylene as polyolefine a) is particularly preferred. The polyolefines a) can be prepared by the usual procedures (Ullmann's Encyclopedia of Industrial Chemistry, Polyolefins, Whiteley, Heggs, Koch, Mawer, Immel, Wiley-VCH Verlag GmbH & Co. KGaA, Weinheim 2005). The production of polyisobutylene is described e.g. in U.S. Pat. Nos. 6,846,903 B2 and 5,962,604 in even more detail. The polyolefine(s) a) preferably has/have of molar mass ($M_n$) of at least 250 g/mol, preferably at least 350 g/mol and more preferred at least 500 g/mol. The polyolefin(s) a) have a maximum molar mass $M_n$ of 10.000 g/mol, preferably 5000 g/mol and more preferred of 2500 g/mol. The most preferred range of the molar mass $M_n$ of polyolefins a) is from 550 to 2000 g/mol.

Also an emulsion, wherein the polymer(s) $P_X$ is/are selected from the group consisting of compounds of group(s) b1), b2), b3) and b4) with b1) being compounds of Formula 1:

1a

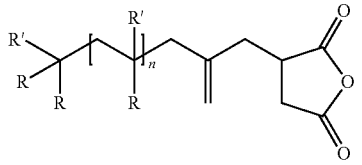

1b

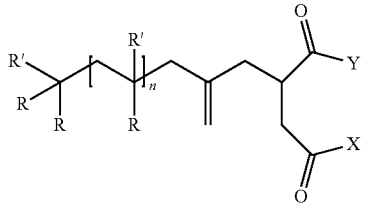

1c

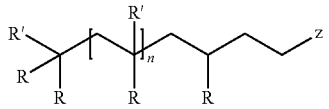

1d

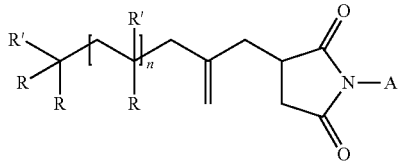

wherein
R=H, methyl,
R'=H, methyl,
each n is independently an integer from 1 to 200,
A=H, alkyl, aryl, alkylamino
X=OH, OR, $NH_2$, $NHR^{\#}$, $NR_2^{\#}$ and their salts
Y=OH, OR, $NH_2$, $NHR^{\#}$, $NR_2^{\#}$ and their salts
Z=OH, $NH_2$, $NHR^{\#}$, $NR_2^{\#}$,
$R^{\#}$=alkyl, aryl
$NR_2^{\#}$=alkyl, aryl, In one aspect, said aryl moieties may be substituted or unsubstituted $C_6$ aryl moieties, said alkyl moieties may be $C_1$-$C_{20}$ linear or branched alkyl moieties and said alkyl moiety of said alkylamine may be a $C_1$-$C_{20}$ linear or branched alkyl moiety.

b2) being compounds of Formula 2:

2a

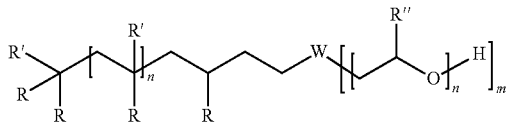

2b

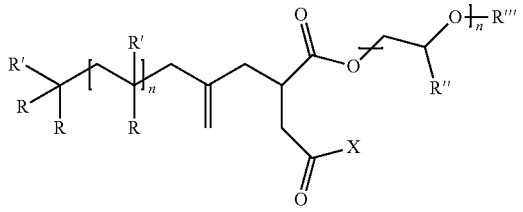

-continued

2c

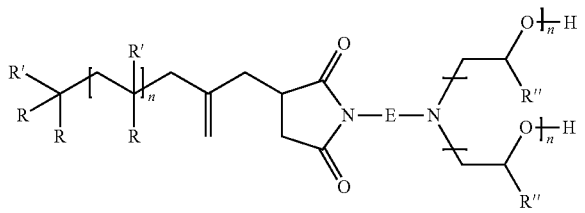

2c wherein:

R=H, methyl,

R'=H, methyl,

R''=H, methyl, ethyl,

R'''=H, alkyl, each n is independently an integer from 1 to 200,

X=$O^-$, OH, OR, $NH_2$, $NHR^{\#}$, $NR_2^{\#}$ and their salts

E=alkyl, aryl, alkylamino, oligoamines having at least two N-atoms, which oligoamines are bridged via $C_2$- to $C_{10}$-alkyle units and which oligoamines have alkoxylated aminofunctions where applicable,

Z=OH, $NH_2$, $NHR^{\#}$, $NR_2^{\#}$,

W=NH, N, O, m=1 or 2, $R^{\#}$=alkyl, aryl, $NR_2^{\#}$=alkyl, aryl,

In one aspect, said aryl moieties may be substituted or unsubstituted $C_6$ aryl moieties, said alkyl moieties may be $C_1$-$C_{20}$ linear or branched alkyl moieties and said alkyl moiety of said alkylamine may be a $C_1$-$C_{20}$ linear or branched alkyl moiety.

b3) being copolymers of polyalkylene(s) of Formula 3

3

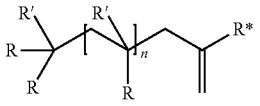

wherein:

R*=H, $CH_3$,

R=H, methyl,

R'=H, methyl, each n is independently an integer from 1 to 200, with monoethylenically unsaturated monomers and b4) being copolymers of ethylene and a monomer selected from the group consisting of anionic monomers, non-ionic monomers and pseudo-cationic monomers is preferred.

The emulsion can comprise one or more polymers of one or more of the groups b1), b2), b3) and b4). If two or more polymers of one group and/or of different groups are present, they can be present in equal amounts or in different amounts.

There exist preferred compounds within each group.

An emulsion comprising a polymer of Formula 1:

1a

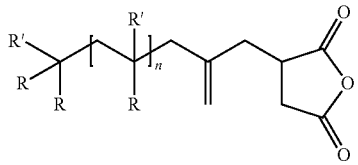

1b

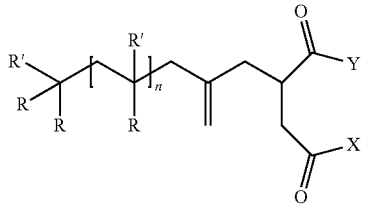

1c

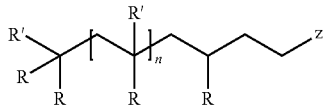

1d

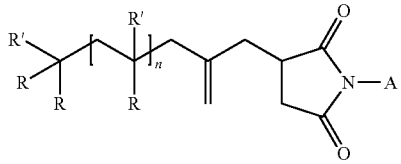

wherein

R=H,

R'=H, each n is independently an integer from 1 to 200,

A=H,

X=OH or its salts,

Y=OH or its salts,

Z=OH forms a preferred embodiment of the present invention.

n is preferably an integer in the range of from 2 to 100, more preferred in the range from 3 to 50 and most preferred in the range from 4 to 30.

An emulsion comprising a polymer of Formula 1, wherein

R=methyl,

R'=methyl, each n is independently an integer from 1 to 200,

A=alkyl,

X=OR,

Y=OR,

Z=OH, forms another preferred embodiment of the present invention.

An emulsion comprising a polymer of Formula 1, wherein

R=H,

R'=methyl, each n is independently an integer from 1 to 200,

A=H,

X=OH and its salts

Y=OH and its salts

Z=$NH_2$, forms another preferred embodiment of the present invention.

An emulsion comprising a polymer of Formula 1, wherein

R=methyl,

R'=methyl, each n is independently an integer from 1 to 200,

A=H

X=OH and their salts

Y=OH and their salts

Z=$NH_2$ forms another preferred embodiment of the present invention.

An emulsion comprising a polymer of Formula 1, wherein
R=methyl,
R'=methyl,
each n is independently an integer from 1 to 200,
A=H
X=$NH_2$, $NHR^{\#}$, $NR_2^{\#}$ and their salts
Y=$O^-$, OH, OR and their salts
Z=$NHR^{\#}$, $NR_2^{\#}$
$R^{\#}$=alkyl, aryl
$NR_2^{\#}$=alkyl, aryl,
forms another preferred embodiment of the present invention.

In one aspect, said aryl moieties may be substituted or unsubstituted $C_6$ aryl moieties, and said alkyl moieties may be $C_1$-$C_{20}$ linear or branched alkyl moieties.

An emulsion comprising a polymer of Formula 2:

2a

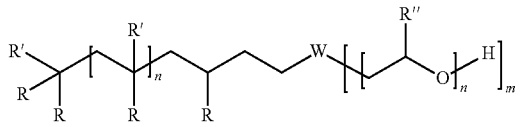

2b

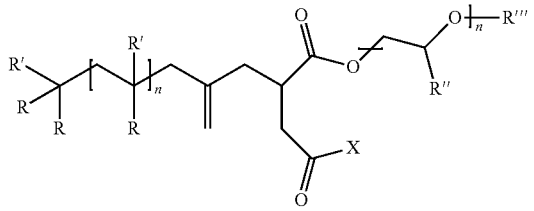

2c

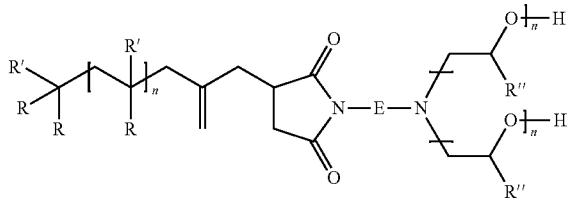

wherein:
R=methyl,
R'=methyl,
R"=methyl,
R'''=methyl,
each n is independently an integer from 1 to 200,
X=OH and its salts
E=alkyl,
Z=OH,
W=NH,
m=1 forms a preferred embodiment of the present invention.

An emulsion comprising a polymer of Formula 2, wherein:
R=H,
R'=H,
R"=H,
R'''=H
each n is independently an integer from 1 to 200,
X=OH and its salts
E=alkyl,
Z=OH,
W=NH,
m=1 forms another preferred embodiment of the present invention.

An emulsion comprising a polymer of Formula 2, wherein:
R=methyl,
R'=methyl,
R"=H
R'''=methyl
each n is independently an integer from 1 to 200,
X=OH and their salts
E=alkyl An emulsion comprising a polymer of Formula 2, wherein:
R=methyl,
R'=methyl,
R"=H
R'''=methyl,
each n is independently an integer from 1 to 200,
X=OH and their salts
E=alkyl
W=N
m=1

An emulsion comprising a polymer of Formula 2, wherein:
R=methyl,
R'=methyl,
R"=H
R'''=methyl,
each n is independently an integer from 1 to 200,
X=OH and their salts
E=alkyl
W=N
m=2

An emulsion comprising a polymer of Formula 2, wherein:
R=methyl,
R'=methyl,
R"=H
R'''=methyl,
each n is independently an integer from 1 to 200,
X=OH and their salts
E=oligoamines having at least two N-atoms, which oligoamines are bridged via $C_2$- to $C_{10}$-alkyle units and which oligoamines have alkoxylated aminofunctions where applicable An emulsion, which comprises copolymers of polyalkylene(s) of Formula 3

3

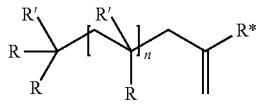

wherein:
R*=H,
R=H,
R'=H,
each n is independently an integer from 1 to 200,
with monoethylenically unsaturated monomers form a preferred embodiment of the present invention.

Also an emulsion, which comprise copolymers of polyalkylene(s) of Formula 3 wherein:
R*=$CH_3$,
R=methyl,
R'=methyl,
each n is independently an integer from 1 to 200,
with monoethylenically unsaturated monomers form a preferred embodiment of the present invention.

In such cases it is preferred, when n is 1 to 100 more preferably 1 to 50 and it is most preferred when n is 10 to 30.

An emulsion comprising polymer(s) b4) being copolymer(s) of ethylene and a monomer selected from the group consisting of anionic monomers, non-ionic monomers and pseudo-cationic monomers forms a preferred embodiment of the present invention.

Non-limiting examples of anionic monomers are acrylic acid, methacrylic acid, vinylphosphoric acid, vinylsulfonic acid, maleic acid and itaconic acid.

Non-limiting examples of non-ionic monomers are: vinyl acetate, vinyl propionate, vinyl silane, vinyl ether derivates, vinyl phosphoric acid diethylesters, vinyl caprolactame, vinyl pyrrolidone, vinyl formamide, all acrylates und methacrylates, that are not ionic—such as: methyl-, ethyl-, propyl-, propylheptyl- and ethylhexyl-methacrylates und-acrylates.

Non-limiting examples of pseudocationic monomers are: ethylenically unsaturated monomers, which comprise at least one quaternizable nitrogen atom, in particular carboxyl-derivatives, such as carbonic acid esters, carbonic acid amides or carbonic acid imides of ethylenically unsaturated mono- or di-carbonic acids, such as acrylic- or methacrylic acid or maleic acid.

Preferably the polymer(s) b4) are selected from the group of compounds characterized by Formula (4):

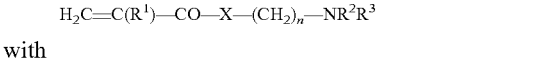

$$H_2C{=}C(R^1){-}CO{-}X{-}(CH_2)_n{-}NR^2R^3 \quad (4)$$

with $R^1$H or methyl,

X O, NH or $NR^4$, $R^2$, $R^3$ and $R^4$ independent from each other are $C_1$- to $C_{20}$-alkyl-groups.

Preferred examples of compounds according to Formula (4) are: 2-(N,N-dimethylamino)ethylacrylate, 2-(N,N-dimethylamino)ethylmethacrylate, N-[2-(N',N'-dimethylamino)ethyl]acrylic acid amide, N-[2-(N',N'-dimethylamino)ethyl]methacrylic acid amide, 3-(N,N-dimethylamino)propylacrylate, 3-(N,N-dimethylamino)propylmethacrylate, N-[3-(N',N'-Dimethylamino)propyl]acrylic acid amide and N-[3-(N',N'-dimethylamino)propyl]methacrylic acid amide.

Useful as monomers are also saturated partly unsaturated and unsaturated heterocycles with five- and six-membered rings, which heterocycles carry an alkenyl-substituent, a vinyl-group in particular and at least one quaternizable tertiary nitrogen atom within the ring, such as N-vinyl imidazole, N-vinyl benzimidazole, N-vinyl-pyrazole, N-vinyl-3-imidazoline, N—($C_1$-$C_{20}$-alkyle)-N'-vinyl piperazine or 2-, 3- or 4-vi-nyl pyridine.

$C_1$- to $C_{20}$-alkyl groups, which can be substituents in the aforementioned monomers can e.g. be methyl, ethyl, n-propyl, iso-propyl, n-butyl, iso-butyl, sec.-butyl, tert.-butyl, n-pentyl, sec.-pentyl, tert.-pentyl, n-hexyl, n-heptyl, n-octyl, 2-ethylhexyl, n-nonyl, iso-nonyl, 2-propylheptyl, n-decyl, n-dodecyl, n-tridecyl, iso-tri-decyl, n-tetradecyl, n-hexydecyl, n-octadecyl and eicosyl.

In a preferred embodiment the quarternized copolymer(s) comprise 2-(N,N-dialkylamino)ethylacrylate, 2-(N,N-dialkylamino)ethylmethacrylate, N-[3-(N',N'-dialkylamino)propyl]acrylamide, N-[3-(N',N'-dialkylamino)propyl]methacrylamide, N-alkyl-N'-vinyl piperazine, N-vinyl imidazole and/or vinyl pyridine.

Particularly preferred are emulsions comprising a copolymer b4) with amino functionalized monomers, with the amino functionalized monomers being selected from the group consisting of dimethylaminoethylmethacrylate (DMAEMA), dimethylaminoethylacrylate (DMAEA), dimethylaminopropylmethacrylamide (DMAPMAM), dimethylaminopropylacrylamide (DMAPAM), hydroxyethylimidazolmethacrylate (HEIMA), hydroxyethylimidazolacrylate (HEIA), n-vinyl imidazole, N-vinyl pyridine and N-vinyl piperazine.

An emulsion, wherein the oil(s) $O_x$ is/are selected from the group consisting of:

c1) mineral oils, having a boiling point at atmospheric pressure of 150° C. or higher c2) esters of $C_{10}$- to $C_{26}$-carboxylic acid with $C_8$-$C_{24}$-alcohols and c3) silicone oils forms a preferred embodiment of the present invention.

Preferred oil(s) are mineral oils available under the names mineral oil light, mineral oil heavy, paraffin liquid or Nujol, that are liquid at room temperature. One example is mineral oil available from Sigma-Aldrich Chemie GmbH, Munich, under the order number 69808.

An emulsion, wherein the surfactant(s) $S_x$ is/are selected from the group consisting of:

d1) nonionic surfactants, d2) anionic surfactants and d3) cationic surfactants is preferred.

Surfactants normally consist of a hydrophobic and a hydrophilic part. Thereby the hydrophobic part normally has a chain length of 4 to 20 C-atoms, preferably 6 to 19 C-atoms and particularly preferred 8 to 18 C-atoms. The functional unit of the hydrophobic group is generally an OH-group, whereby the alcohol can be linear or branched. The hydrophilic part generally consists substantially of alkoxylated units (e.g. ethylene oxide (EO), propylene oxide (PO) and/or butylene oxide (BO), whereby generally 2 to 30, preferably 5 to 20 of these alkoxylated units are annealed, and/or charged units such as sulfate, sulfonate, phosphate, carbonic acids, ammonium and ammonium oxide.

Examples of anionic surfactants are: carboxylates, sulfonates, sulfo fatty acid methylesters, sulfates, phosphates. Examples for cationic surfactants are: quartery ammonium compounds. Examples for betaine-surfactants are: alkyl betaines. Examples for non-ionic compounds are: alcohol alkoxylates.

A "carboxylate" is a compound, which comprises at least one carboxylate-group in the molecule. Examples of carboxylates, which can be used according to the present invention, are soaps—e.g. stearates, oleates, cocoates of alkali metals or of ammonium, ethercarboxylates—e.g. Akypo® RO 20, Akypo® RO 50, Akypo® RO 90.

A "sulfonate" is a compound, which comprises at least one sulfonate-group in the molecule. Examples of sulfonates, which can be used according to the invention, are alkyl benzene sulfonates—e.g. Lutensit® A-LBS, Lutensit® A-LBN, Lutensit® A-LBA, Marlon® AS3, Maranil® DBS, alkyl sulfonates—e.g. Alscoap OS-14P, BIO-TERGE® AS-40, BIO-TERGE® AS-40 CG, BIO-TERGE® AS-90 Beads, Calimulse® AOS-20, Calimulse® AOS-40, Calsoft® AOS-40, Colonial® AOS-40, Elfan® OS 46, Ifrapon® AOS 38, Ifrapon® AOS 38 P, Jeenate® AOS-40, Nikkol® OS-14, Norfox® ALPHA XL, POLYSTEP® A-18, Rhodacal® A-246L, Rhodacal® LSS-40/A, sulfonated oils such as Turkish red oil, olefine sulfonates, aromatic sulfonates—e.g. Nekal® BX, Dowfax® 2A1.

A "sulfo fatty acid methylester" is a compound, having the following general Formula (V):

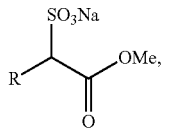

(V)

wherein R has 10 to 20 C-atoms; preferably 12 to 18 and particularly preferred 14 to 16 C-atoms.

A "sulfate" is a compound, which comprises at least one $SO_4$-group in the molecule. Examples of sulfates, which can be used according to the present invention, are

- fatty acid alcohol sulfates such as coco fatty alcohol sulfate (CAS 97375-27-4)—e.g. EMAL® 10G, Dispersogen® SI, Elfan® 280, Mackol® 100N,
- other alcohol sulfates—e.g. Emal® 71, Lanette® E,
- coco fatty alcohol ethersulfates—e.g. Emal® 20C, Latemul® E150, Sulfochem® ES-7, Texapon® ASV-70 Spec., Agnique® SLES-229-F, Octosol 828, POLYSTEP® B-23, Unipol® 125-E, 130-E, Unipol® ES-40,
- other alcohol ethersulfates—e.g. Avanel® S-150, Avanel® S150 CG, Avanel® S150 CG N, Witcolate® D51-51, Witcolate® D51-53.

A "phosphate" is a compound, which comprises at least one $PO_4$-group. Examples of phosphates, which can be used according to the present invention, are

- alkyl ether phosphates—e.g. Maphos® 37P, Maphos® 54P, Maphos® 37T, Maphos® 210T and Maphos® 210P,
- phosphates such as Lutensit® A-EP,
- alkyl phosphates.

When producing the chemical composition of the present invention the anionic surfactants are preferably added as salts. Acceptable salts are e.g. alkali metal salts, such as sodium-, potassium- and lithium salts, and ammonium salts, such as hydroxyl ethylammonium-, di(hydroxyethyl)ammonium- and tri(hydroxyethyl)ammonium salts.

One group of the cationic surfactants are the quartery ammonium compounds.

A "quartery ammonium compound" is a compound, which comprises at least one $R_4N^+$-group per molecule. Examples of counter ions, which are useful in the quartery ammonium compounds, are

- halogens, methosulfates, sulfates and carbonates of coco fat-, sebaceous fat- or cetyl/oleyltrimethylammonium.

Particularly suitable cationic surfactants are:

- N,N-dimethyl-N-(hydroxy-$C_7$-$C_{25}$-alkyl)ammonium salts;
- mono- and di-($C_7$-$C_{25}$-alkyl)dimethylammonium compounds, which are quarternised with alkylating agents
- esterquats, especially mono-, di- and trialkanolamines, quarternary esterified by $C_8$-$C_{22}$-carbonic acids;
- imidazolinquats, especially 1-alkylimidazoliniumsalts of Formula (VI) or (VII)

Formula (VI)

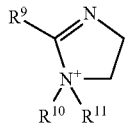

-continued

Formula (VII)

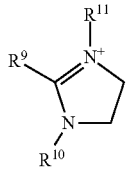

wherein the variables have the following meaning:

$R^9$ $C_1$-$C_{25}$-alkyl or $C_2$-$C_{25}$-alkenyl;

$R^{10}$ $C_1$-$C_4$-alkyl or hydroxy-$C_1$-$C_4$-alkyl;

$R^{11}$ $C_1$-$C_4$-alkyl, hydroxy-$C_1$-$C_4$-alkyl or a rest $R^1$—(CO)—X—$(CH_2)_m$— (X:—O— or —NH—; m: 2 or 3), whereby at least one rest $R^9$ is $C_7$-$C_{22}$-alkyl.

A "betain-surfactant" is a compound, which comprises under conditions of use—i.e. in the case of textile washing under normal pressure and at temperatures of from room temperature to 95° C.—at least one positive charge and at least one negative charge. An "alkylbetain" is a betain-surfactant, which comprises at least one alkyl-unit per molecule. Examples of betain-surfactants, which can be used according to the invention, are Cocamidopropylbetain—e.g. MAFO® CAB, Amonyl® 380 BA, AMPHOSOL® CA, AMPHOSOL® CG, AMPHOSOL® CR, AMPHOSOL® HCG; AMPHOSOL® HCG-50, Chembetaine® C, Chembetaine® CGF, Chembetaine® CL, Dehyton® PK, Dehyton® PK 45, Emery® 6744, Empigen® BS/F, Empigen® BS/FA, Empigen® BS/P, Genagen® CAB, Lonzaine® C, Lonzaine® CO, Mirataine® BET-C-30, Mirataine® CB, Monateric® CAB, Naxaine® C, Naxaine® CO, Norfox® CAPB, Norfox® Coco Betaine, Ralufon® 414, TEGO®-Betain CKD, TEGO® Betain E KE 1, TEGO®-Betain F, TEGO®-Betain F 50 and aminoxides such as alkyl dimethyl amineoxide, i.e. compounds of general Formula (VIII)

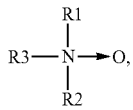

(VIII)

whereby R1, R2 and R3 are chosen independently from each other of an aliphatic, cyclic or tertiary alkyl- or amido alkyl-moiety, e.g. Mazox® LDA, Genaminox®, Aromox® 14 DW 970.

Non-ionic surfactants are interfacially active substances having a head group, which is an uncharged, polar, hydrophilic group, not carrying an ionic charge at neutral pH, and which head group makes the non-ionic surfactant water soluble. Such a surfactant adsorbs at interfaces and aggregates to micelles above the critical micelle concentration (cmc). According to the type of the hydrophilic head group it can be distinguished between (oligo)oxyalkylene-groups, especially (oligo)oxyethylene-groups, (polyethyleneglycol-groups), including fatty alcohol polyglycole ether (fatty alcohol alkoxylates), alkylphenol polyglycolether and fatty acid ethoxylates, alkoxylated triglycerides and mixed ethers (polyethylene glycolether alcoxylated on both sides); and carbohydrate-groups, including e.g. alkyl polyglucosides and fatty acid-N-methylglucamides.

Alcohol alkoxylates, are based on a hydrophobic part having a chain length of 4 to 20 C-atoms, preferably 6 to 19 C-atoms and particularly preferred 8 to 18 C-atoms, whereby the alcohol can be linear or branched, and a hydrophilic part, which can be alkoxylated units, e.g. ethylene oxide (EO), propylene oxide (PO) and/or butylene oxide (BuO), having 2 to 30 repeating units. Examples are besides others Lutensol® XP, Lutensol® XL, Lutensol® ON, Lutensol® AT, Lutensol® A, Lutensol® AO, Lutensol® TO.

Alcoholphenolalkoxylates are compounds according to general Formula (IX), (IX)

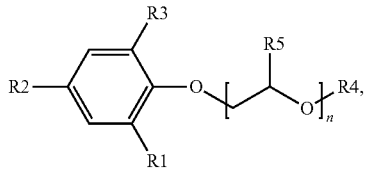

which can be produced by addition of alkylene oxide, preferably ethylene oxide onto alkyle phenoles. Preferably R4=H. It is also preferred, if R5=H,—since than it is EO; in the same way it is preferred if R5=$CH_3$, since than it is PO, or, if R5=$CH_2CH_3$ since than it is BuO. A compound is especially preferred, in which octyl-[(R1=R3=H, R2=1,1,3,3-tetramethylbutyl (diisobutylene)], nonyl-[(R1=R3=H, R2=1,3,5-trimethylhexyl (tripropylene)], dodecyl-, dinonyl- or tributylphenolpolyglycolether (e.g. EO, PO, BuO), R—$C_6H_4$—O-(EO/PO/BuO)$_n$ with R=C8 to C12 and n=5 to 10, are present. Non-limiting examples of such compounds are: Norfox® OP-102, Surfonic® OP-120, T-Det® 0-12.

Fatty acid ethoxilates are fatty acid esters, which have been treated with different amounts of ethylene oxide (EO).

Triglycerides are esters of the glycerols (glycerides), in which all three hydroxy-groups have been esterified using fatty acids. These can be modified by alkylene oxides.

Fatty acid alkanol amides are compounds of general Formula (X)

(X)

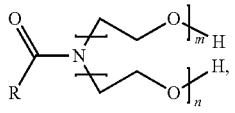

which comprise at least one amide-group having one alkyle moiety R and one or two alkoxyl-moiety(ies), whereby R comprises 11 to 17 C-atoms and $1 \leqq m+n \leqq 5$.

Alkylpolyglycosides are mixtures of alkylmonoglucosides (alkyl-α-d- and -β-d-glucopyranoside plus small amounts of -glucofuranoside), alkyldiglucosides (-isomaltosides, -maltosides and others) and alkyloligoglucosides (-maltotriosides, -tetraosides and others). Alkylpolyglycosides are among other routes accessible by acid catalysed reaction (Fischer-reaction) from glucose (or starch) or from n-butylglucosides with fatty alcohols. Alkylpolyglycosides fit general Formula (XI)

(XI)

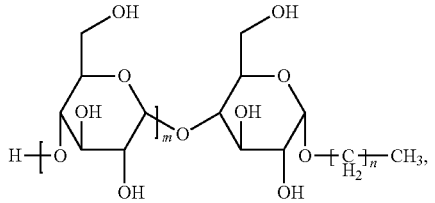

with m=0, 1, 2, or 3 and each n is independently an integer from 4 to 20.

One example is Lutensol® GD70.

In the group of non-ionic N-alkylated, preferably N-methylated, fatty acid amides of general Formula (XII)

(XII)

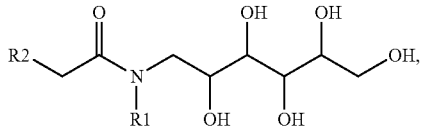

R1 is an n-$C_{12}$-alkyl-moiety, R2 an alkyl-moiety having 1 to 8 C-atoms. R2 preferably is methyl.

An emulsion, wherein the additive(s) $A_x$ is/are selected from the group consisting of: disinfectant, dye, acid, base, complexing agent, biocide, hydrotope, thickener, builder, cobuilder, enzyme, bleaching agent, bleach activator, bleaching catalyst, corrosion inhibitor, dye protection additive, dye transfer inhibitor, anti-greying agent, soil-release-polymer, fiber protection agent, silicon, bactericide, preserving agent, organic solvent, solubility adjustor, solubility enhancer and perfume is preferred.

Disinfectants can be: oxidation agents, halogens such as chlorine and iodine and substances, which release the same, alcohols such as ethanol, 1-propanol and 2-propanol, aldehydes, phenoles, ethylene oxide, chlorohexidine and mecetroniummetilsulfate.

The advantage of using disinfectants is that pathogenic germs can hardly grow. Pathogenic germs can be: bacteria, spores, fungi and viruses.

Dyes can be besides others: Acid Blue 9, Acid Yellow 3, Acid Yellow 23, Acid Yellow 73, Pigment Yellow 101, Acid Green 1, Acid Green 25.

Acids are compounds that can advantageously be used to solve or to avoid scaling. Non-limiting examples of acids are formic acid, acetic acid, citric acid, hydrochloric acid, sulfuric acid and sulfonic acid.

Bases are compounds, which are useful for adjusting a preferable pH-range for complexing agents. Examples of bases, which can be used according to the present invention, are: NaOH, KOH and amine ethanol.

As inorganic builder the following are especially useful:

- crystalline and amorphous alumo silicates having ion exchanging properties, such as zeolites: different types of zeolites are useful, especially those of type A, X, B, P, MAP and HS in their Na-modification or in modifications in which Na is partially substituted by other cat ions such as Li, K, Ca, Mg or ammonium;
- crystalline silicates, such as disilicates and layer-silicates, e.g. δ- and β-$Na_2Si_2O_5$. The silicates can be used as alkali metal-, earth alkali metal- or ammonium salts, the Na-, Li- and Mg-silicates are preferred;
- amorphous silicates, such as sodium metasilicate and amorphous disilicate;
- carbonates and hydrogencarbonates: These can be used as alkali metal-, earth alkali metal- or ammonium salts. Na-, Li- and Mg-carbonates and -hydrogen carbonate, especially sodium carbonate and/or sodium hydrogen carbonate are preferred;
- polyphosphates, such as pentanatriumtriphosphate.

Useful as oligomeric and polymeric cobuilders are:

Oligomeric and polymeric carbonic acids, such as homopolymers of acrylic acid and aspartic acid, oligomaleic acid, copolymers of maleic acid and acrylic acid, methacrylic acid or $C_2$-$C_{22}$-olefines, e.g. isobutene or long chain α-olefines, vinyl-$C_1$-$C_8$-alkylether, vinylacetate, vinylpropionate, (meth)acryl acid ester of $C_1$-$C_8$-alcohols and styrene. Preferred are the homopolymers of acrylic acid and the copolymers of acrylic acid with maleic acid. The oligomeric and polymeric carbonic acids preferably are used as acids or as sodium salts.

Chelating agents are compounds, which can bind cat ions. They can be used to reduce water hardness and to precipitate heavy metals. Examples of complexing agents are: NTA, EDTA, MGDA, DTPA, DTPMP, IDS, HEDP, β-ADA, GLDA, citric acid, oxodisuccinic acid and butanetetracarbonic acid. The advantage of the use of these compounds lies in the fact that many compounds, which serve as cleaning agents, are more active in soft water. In addition to that scaling can be reduced or even be avoided. By using such compounds there is no need to dry a cleaned surface. This is an advantage in the work flow.

Useful anti greying agents are e.g. carboxymethylcellulose and graft polymers of vinyl acetate on polyethylene glycol.

Useful bleaching agents are e.g. adducts of hydrogen peroxide at inorganic salts, such as sodium perborate-monohydrate, sodium perborate-tetrahydrate and sodium carbonate-perhydrate, and percarbonic acids, such as phthalimidopercapronic acid.

As bleach activators compounds such as N,N,N',N'-tetraacetylethylendiamine (TAED), sodium-p-nonanoyloxybenzenesulfonate and N-methylmorpholiniumacetonitrilemethyl-sulfate are useful.

Useful enzymes are e.g. proteases, lipases, amylases, cellulases, mannanases, oxidases and peroxidases.

Useful as dye transfer inhibitors are e.g. homo-, co- and graft-polymers of 1-vinylpyrrolidone, 1-vinylimidazol or 4-vinylpyridine-N-oxide. Also homo- and copolymers of 4-vinylpyridin, which have been treated with chloro acetic acid are useful dye transfer inhibitors.

Biozides are compounds, which kill bacteria. An example of a biozide is glutaric aldehyde. The advantage of the use of biozides is that the spreading of pathogenic germs is counteracted.

Hydrotropes are compounds which enhance the solubility of the surfactant/the surfactants in the chemical composition. An example is: Cumolsulfonate.

Thickeners are compounds, which enhance the viscosity of the chemical composition. Non-limiting examples of thickeners are: polyacrylates and hydrophobically modified polyacrylates. The advantage of the use of thickeners is, that liquids having a higher viscosity have a longer residence time on the surface to be treated in the cases this surface is inclined or even vertical. This leads to an enhanced time of interaction.

An emulsion, which has a content of organic solvent below 50 mg/kg of emulsion is particularly preferred.

An emulsion according as described above, which is stable for more than 2 days according to the phase-stability-test forms a preferred embodiment of the present invention.

Phase-Stability-Test:

The stability of the emulsion is tested by visual inspection via the phase-stability-test. After preparation, the emulsion is stored in a closed graduated cylinder (Hirschmann Duran 100 ml volume, NS24/29) at room temperature without agitation. After 1 h, 4 h, 24 h and 48 h, the emulsion is inspected for phase separation.

- The emulsion is defined stable when no visually observable phase separation occurs after 48 h.
- The emulsion is defined as re-emulsifiable when phase separation occurs after 48 h, but the emulsion is immediately reformed upon slight shaking or stifling with low shear, for example with a magnetic stirrer bar, and the reformed emulsion is stable again for at least four hours.
- The emulsion is defined unstable, when phase separation occurs shortly after preparation and the emulsion can not be reformed by slight shaking or stifling with low shear, for example with a magnetic stirrer bar.

A process for making an emulsion as described above, comprising the steps of: combining polyolefine(s), polymer(s) $P_x$, water and optionally oil(s) $O_x$, surfactant(s) $S_x$ and additives $A_x$ and homogenizing said components in a mechanical mixer without the use of a solvent forms another aspect of the present invention.

Regarding the details of the process different versions are possible.

The emulsions can be prepared by processes known in the literature, for example in Heusch, R., "Ullmann's Encyclopedia of Industrial Chemistry", Chapter "Emulsions", 1-47, Wiley-VCH, 2000 (DOI: 10.1002/14356007.a09_297) or in Kostansek, E., "Kirk-Othmer Encyclopedia of Chemical Technology", Vol. 10, 113-133, Chapter "Emulsions", John Wiley & Sons 2003 (DOI: 10.1002/0471238961.0513211206180902.a01.pub2).

Suitable emulsifying machines are for example high-speed stirrers, agitation or impact machines, emulsifier centrifuges, colloid mills, metering pumps (atomizers), vibrators, ultrasonic generators and homogenizers.

In one preferred embodiment of the invention, the preparation of the emulsion is achieved via a solvent-free route (a solvent being a substance with a boiling point below 150° C. that can dissolve polyisobutene, for example o-xylene) by combination of the components, comprising polyisobutene, polymer(s) $P_x$, water, optionally surfactant, optionally oil and optionally further additives such as defoamers etc., and homogenization with a suitable device, like for example a high-shear mixer or for example a high-pressure homogenizer, optionally at elevated temperatures.

The step of combining the components can vary: in one preferred embodiment, polymer(s) $P_x$ is dissolved in polyisobutene, optionally comprising oil(s) and/or additional components, and then combined with the water phase, comprising water, optionally surfactant and additional components.

In another preferred embodiment, polymer(s) $P_x$ is dissolved in the water phase, comprising water, optionally surfactant and/or additional components, and then combined with polyisobutene phase, comprising polyisobutene and optionally oil(s) and/or additional components.

In another preferred embodiment of the invention, the preparation of the emulsion is achieved via a solvent route. The solvent route is especially suitable to prepare emulsions with anionic polymer(s) $P_x$. The components of the emulsion, comprising polyisobutene and polymer(s) $P_x$, are dissolved in a solvent, for example o-xylene, in a stirred reactor, optionally at elevated temperatures. After complete dissolution, water is added to the solution and the mixture is distilled, optionally under addition of water steam, at elevated temperature (above 80° C.) until the solvent is removed.

The use of an emulsion as described above in chemical technical applications, cosmetics, plant protection, preparation and treatment of paper, textiles and leather, adhesives, dye and pigment formulations, coatings, pharmaceutical applications, construction, wood treatment forms another aspect of the present invention.

The present invention will be disclosed further by the following non-limiting examples:

Fabric and Home Care Compositions

A composition comprising:

a) an emulsion comprising, based on the total mass of the emulsion, i) from about 2% to about 75% of a polyolefine;

ii) from about 0.05% to about 40% of a polymer $P_x$;

iii) from about 0% to about 25% of an oil $O_x$;

iv) from about 0% to about 25% of a surfactant $S_x$;

v) from about 0% to about 20% of a additive $A_x$; and vi) from about 10% to about 97.95% water;

b) an adjunct ingredient said composition being a fabric and home care product, is disclosed.

In one aspect, of said composition the components of said emulsion may, independently of each other, be present in amounts of:

i) from about 5% to about 50% of a polyolefine;

ii) from about 0.5% to about 30% of a polymer $P_x$;

iii) from about 0.1% to about 25% of an oil $O_x$;

iv) from about 0.1% to about 20% of a surfactant $S_x$;

v) from about 0.1% to about 15% of a additive $A_x$; and vi) from about 30% to about 90% water;

based on the total mass of the emulsion.

In one aspect, of said composition the components of said emulsion may, independently of each other, be present in amounts of:

i) from about 10% to about 40% of a polyolefine;

ii) from about 0.5% to about 15% of a polymer $P_x$;

iii) from about 5% to about 20% of an oil $O_x$;

iv) from about 0.1% to about 15% of a surfactant $S_x$;

v) from about 0.1% to about 10% of a additive $A_x$; and vi) from about 40% to about 85% water;

based on the total mass of the emulsion.

In one aspect, of said composition the components of said emulsion may, independently of each other, be present in amounts of:

i) from about 15% to about 30% of a polyolefine;

ii) from about 0.5% to about 5% of a polymer $P_x$;

iii) from about 10% to about 20% of an oil $O_x$;

iv) from about 0.5% to about 10% of a surfactant $S_x$;

v) from about 2% to about 8% of a additive $A_x$; and vi) from about 50% to about 80% water based on the total mass of the emulsion.

In one aspect, of said composition said polyolefine may be selected from the group consisting of: polyethylene, polypropylene, polybutylene, polyisobutylene and mixtures thereof.

In one aspect, of said composition said polymer $P_X$ may be selected from the group consisting of compounds of group(s) b1), b2), b3), b4) and mixtures thereof;

with b1) being compounds of Formula 1:

1a

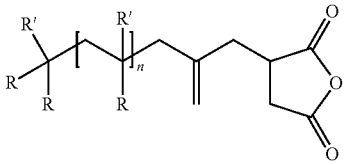

1b

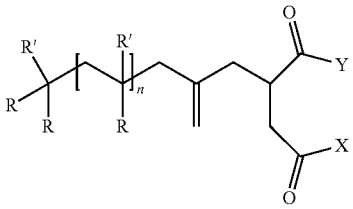

1c

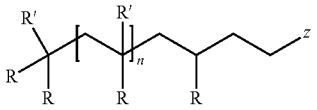

-continued

1d

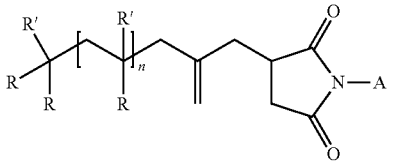

wherein wherein each R is independently H or methyl, each R' is independently H or methyl, each n is independently an integer from 1 to 200, A is selected from H, alkyl, aryl, or alkylamino X is selected from $O^-$, OH, OR, $NH_2$, $NHR^{\#}$, or $NR_2^{\#}$ or their salts Y is selected from $O^-$, OH, OR, $NH_2$, $NHR^{\#}$, or $NR_2^{\#}$ or their salts Z is selected from OH, $NH_2$, $NHR^{\#}$, or $NR_2^{\#}$, each $R^{\#}$ is independently alkyl or aryl each $NR_2^{\#}$ is independently alkyl or aryl, b2) being compounds of Formula 2:

2a

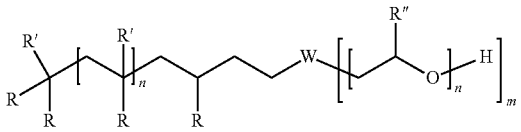

2b

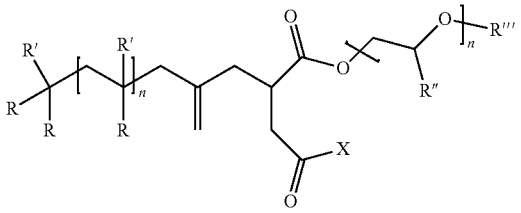

2c

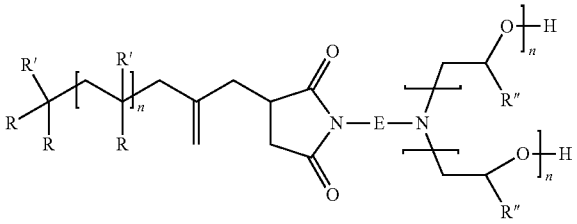

wherein:

each R is independently H or methyl, each R' is independently H or methyl,

R" is H, methyl or ethyl,

R'" is H or alkyl, each n is independently an integer from 1 to 200,

X is selected from $O^-$, OH, OR, $NH_2$, $NHR^{\#}$, $NR_2^{\#}$ and their salts E is selected from H, alkyl, aryl, alkylamino, oligoamines having at least two N-atoms, which oligoamines are bridged via $C_2$- to $C_{10}$-alkyle units and which oligoamines have alkoxylated aminofunctions where applicable, Z is selected from OH, $NH_2$, $NHR^{\#}$, or $NR_2^{\#}$, W is selected from NH, N, or O, m=1 or 2, each $R^{\#}$ is independently alkyl or aryl, each $NR_2^{\#}$ is independently alkyl or aryl, b3) being copolymers of polyalkylene(s) of Formula 3

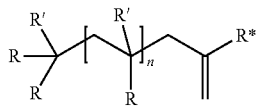

wherein:

R* is H or $CH_3$, each R is independently H or methyl, each R' is independently H or methyl, each n is independently an integer from 1 to 200, with monoethylenically unsaturated monomers and b4) being copolymers of ethylene and a monomer selected from the group consisting of anionic monomers, non-ionic monomers and pseudo-cationic monomers.

In one aspect, of said composition said oil $O_x$ may be selected from the group consisting of:

c1) mineral oils, having a boiling point at atmospheric pressure of 150° C. or higher;

c2) esters of $C_{10}$- to $C_{26}$-carboxylic acid with $C_8$-$C_{24}$-alcohols;

c3) silicone oils; and mixtures thereof.

In one aspect, of said composition the surfactant $S_x$ may be selected from the group consisting of:

d1) nonionic surfactants;

d2) anionic surfactants;

d3) cationic surfactants; and mixtures thereof.

In one aspect, of said composition said emulsion may have a content of organic solvent below 50 mg/kg of emulsion.

In one aspect, of said composition said emulsion may be stable for more than 2 days according to the phase-stability-test.

In one or more aspects of said composition, said composition may comprise and/or have any combination of materials and/or parameters disclosed in the preceding aspects of said composition.

Aspects of the invention include the use of the emulsion disclosed herein in laundry detergent compositions (e.g., TIDE™), hard surface cleaners (e.g., MR CLEAN™), automatic dishwashing liquids (e.g., CASCADE™), dishwashing liquids (e.g., DAWN™), and floor cleaners (e.g., SWIFFER™). Non-limiting examples of cleaning compositions may include those described in U.S. Pat. Nos. 4,515,705; 4,537,706; 4,537,707; 4,550,862; 4,561,998; 4,597,898; 4,968,451; 5,565,145; 5,929,022; 6,294,514; and 6,376,445. The cleaning compositions disclosed herein are typically formulated such that, during use in aqueous cleaning operations, the wash water will have a pH of between about 6.5 and about 12, or between about 7.5 and 10.5. Liquid dishwashing product formulations typically have a pH between about 6.8 and about 9.0. Cleaning products are typically formulated to have a pH of from about 7 to about 12. Techniques for controlling pH at recommended usage levels include the use of buffers, alkalis, acids, etc., and are well known to those skilled in the art.

Fabric treatment compositions disclosed herein typically comprise a fabric softening active ("FSA") and a nonionic care agent disclosed herein. Suitable fabric softening actives, include, but are not limited to, materials selected from the group consisting of quats, amines, fatty esters, sucrose esters, silicones, dispersible polyolefins, clays, polysaccharides, fatty oils, polymer latexes and mixtures thereof.

Adjunct Materials

The disclosed compositions may include additional adjunct ingredients. Adjunct ingredients include, but are not limited to, deposition aids, bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softeners, carriers, hydrotropes, processing aids and/or pigments. The adjunct ingredients are in addition to an materials that are specifically recited in an embodiment that is disclosed and/or claimed. Each adjunct ingredient may be not essential to Applicants' compositions. Thus, certain embodiments of Applicants' compositions do not contain one or more of the following adjuncts materials: a deposition aids, bleach activators, surfactants, builders, chelating agents, dye transfer inhibiting agents, dispersants, enzymes, and enzyme stabilizers, catalytic metal complexes, polymeric dispersing agents, clay and soil removal/anti-redeposition agents, brighteners, suds suppressors, dyes, additional perfumes and perfume delivery systems, structure elasticizing agents, fabric softeners, carriers, hydrotropes, processing aids and/or pigments. However, when one or more adjuncts are present, such one or more adjuncts may be present as detailed below The following is a non-limiting list of suitable additional adjuncts.

Deposition Aid—In one aspect, the fabric treatment composition may comprise from about 0.01% to about 10%, from about 0.05 to about 5%, or from about 0.15 to about 3% of a deposition aid. Suitable deposition aids are disclosed in, for example, U.S. patent application Ser. No. 12/080,358.

In one aspect, the deposition aid may be a cationic or amphoteric polymer. In another aspect, the deposition aid may be a cationic polymer. Cationic polymers in general and their method of manufacture are known in the literature. In one aspect, the cationic polymer may have a cationic charge density of from about 0.005 to about 23, from about 0.01 to about 12, or from about 0.1 to about 7 milliequivalents/g, at the pH of intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

Non-limiting examples of deposition enhancing agents are cationic or amphoteric, polysaccharides, proteins and synthetic polymers. Cationic polysaccharides include cationic cellulose derivatives, cationic guar gum derivatives, chitosan and derivatives and cationic starches. Cationic polysaccharides have a molecular weight from about 50,000 to about 2 million, or even from about 100,000 to about 3,500,000. Suitable cationic polysaccharides include cationic cellulose ethers, particularly cationic hydroxyethylcellulose and cationic hydroxypropylcellulose. Examples of cationic hydroxyalkyl cellulose include those with the INCI name Polyquaternium10 such as those sold under the trade names Ucare™ Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name Celquat™ H200 and Celquat™ L-200 available from National Starch and Chemical Company, Bridgewater, N.J. Other suitable polysaccharides include Hydroxyethyl cellulose or hydroxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33-col. 4, line 67. Cationic galactomannans include cationic guar gums or cationic locust bean gum. An example of a cationic guar gum is a quaternary ammonium derivative of Hydroxypropyl Guar such as those sold under the trade name Jaguar® C13 and Jaguar® Excel available from Rhodia, Inc of Cranbury N.J. and N-Hance by Aqualon, Wilmington, Del.

Another group of suitable cationic polymers includes those produced by polymerization of ethylenically unsaturated monomers using a suitable initiator or catalyst, such as those disclosed in U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, C1-C12 alkyl acrylate, C1-C12 hydroxyalkyl acrylate, polyalkylene glyol acrylate, C1-C12 alkyl methacrylate, C1-C12 hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and cros slinking monomers include ethylene glycoldiacrylate divinylbenzene, and butadiene. In another aspect, the treatment composition may comprise an amphoteric deposition aid polymer so long as the polymer possesses a net positive charge. Said polymer may have a cationic charge density of about 0.05 milliequivalents/g. to about 18 milliequivalents/g.

In another aspect, the deposition aid may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable deposition aids include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients. In one aspect, the deposition aid may comprise polyethyleneimine or a polyethyleneimine derivative. A suitable polyethyleneinine useful herein is that sold under the trade name Lupasol® by BASF, AG, and Ludwigshafen, Germany In another aspect, the deposition aid may comprise a cationic acrylic based polymer. In a further aspect, the deposition aid may comprise a cationic polyacrylamide. In another aspect, the deposition aid may comprise a polymer comprising polyacrylamide and polymethacrylamidopropyl trimethylammonium cation. In another aspect, the deposition aid may comprise poly(acrylamide-N-dimethyl aminoethyl acrylate) and its quaternized derivatives. In this aspect, the deposition aid may be that sold under the trade name Sedipur®, available from BTC Specialty Chemicals, a BASF Group, Florham Park, N.J. In a yet further aspect, the deposition aid may comprise poly(acrylamide-co-methacrylamidopropyltrimethyl ammonium chloride). In another aspect, the deposition aid may comprise a non-acrylamide based polymer, such as that sold under the trade name Rheovis® CDE, available from Ciba Specialty Chemicals, a BASF group, Florham Park, N.J., or as disclosed in USPA 2006/0252668.

In another aspect, the deposition aid may be selected from the group consisting of cationic or amphoteric polysaccharides. In one aspect, the deposition aid may be selected from the group consisting of cationic and amphoteric cellulose ethers, cationic or amphoteric galactomannan, cationic guar gum, cationic or amphoteric starch, and combinations thereof.

Another group of suitable cationic polymers may include alkylamine-epichlorohydrin polymers which are reaction products of amines and oligoamines with epichlorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

Another group of suitable synthetic cationic polymers may include polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The weight-average molecular weight of the polymer may be from about 500 Daltons to about 5,000,000 Daltons, or from about 1,000 Daltons to about 2,000,000 Daltons, or from about 2,500 Daltons to about 1,500,000 Daltons, as determined by size exclusion chromatography relative to polyethylene oxide standards with RI detection. In one aspect, the MW of the cationic polymer may be from about 500 Daltons to about 37,500 Daltons.

Surfactants: The products of the present invention may comprise from about 0.11% to 80% by weight of a surfactant. In one aspect, such compositions may comprise from about 5% to 50% by weight of surfactant. Surfactants utilized can be of the anionic, nonionic, zwitterionic, ampholytic or cationic type or can comprise compatible mixtures of these types. Detergent surfactants useful herein are described in U.S. Pat. Nos. 3,664,961, 3,919,678, 4,222,905, 4,239,659, 6,136,769, 6,020,303, and 6,060,443.

Anionic and nonionic surfactants are typically employed if the fabric care product is a laundry detergent. On the other hand, cationic surfactants are typically employed if the fabric care product is a fabric softener.

Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkylolammonium salts of higher fatty acids containing from about 8 to about 24 carbon atoms, or even from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants include the water-soluble salts, particularly the alkali metal, ammonium and alkylolammonium (e.g., monoethanolammonium or triethanolammonium) salts, of organic sulfuric reaction products having in their molecular structure an alkyl group containing from about 10 to about 20 carbon atoms and a sulfonic acid or sulfuric acid ester group. (Included in the term "alkyl" is the alkyl portion of aryl groups.) Examples of this group of synthetic surfactants are the alkyl sulfates and alkyl alkoxy sulfates, especially those obtained by sulfating the higher alcohols ($C_8$-$C_{18}$ carbon atoms).

Other useful anionic surfactants herein include the water-soluble salts of esters of α-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; water-soluble salts of olefin sulfonates containing from about 12 to 24 carbon atoms; and β-alkyloxy alkane sulfonates containing from about 1 to 3 carbon atoms in the alkyl group and from about 8 to 20 carbon atoms in the alkane moiety. In another embodiment, the anionic surfactant may comprise a $C_{11}$-$C_{18}$ alkyl benzene sulfonate surfactant; a $C_{10}$-$C_{20}$ alkyl sulfate surfactant; a $C_{10}$-$C_{18}$ alkyl alkoxy sulfate surfactant, having an average degree of alkoxylation of from 1 to 30, wherein the alkoxy comprises a $C_1$-$C_4$ chain and mixtures thereof; a mid-chain branched alkyl sulfate surfactant; a mid-chain branched alkyl alkoxy sulfate surfactant having an average degree of alkoxylation of from 1 to 30, wherein the alkoxy comprises a $C_1$-$C_4$ chain and mixtures thereof; a $C_{10}$-$C_{18}$ alkyl alkoxy carboxylates comprising an average degree of alkoxylation of from 1 to 5; a $C_{12}$-$C_{20}$ methyl ester sulfonate surfactant, a $C_{10}$-$C_{18}$ alpha-olefin sulfonate surfactant, a $C_6$-$C_{20}$ sulfosuccinate surfactant, and a mixture thereof.

In addition to the anionic surfactant, the fabric care compositions of the present invention may further contain a nonionic surfactant. The compositions of the present invention can contain up to about 30%, alternatively from about 0.01% to about 20%, more alternatively from about 0.1% to about 10%, by weight of the composition, of a nonionic surfactant. In one embodiment, the nonionic surfactant may comprise an ethoxylated nonionic surfactant. Examples of suitable nonionic surfactants are provided in U.S. Pat. Nos. 4,285,841, 6,150,322, and 6,153,577.

Suitable for use herein are the ethoxylated alcohols and ethoxylated alkyl phenols of the formula $R(OC_2H_4)n$ OH, wherein R is selected from the group consisting of aliphatic hydrocarbon radicals containing from about 8 to about 20 carbon atoms and alkyl phenyl radicals in which the alkyl groups contain from about 8 to about 12 carbon atoms, and the average value of n is from about 5 to about 15.

Suitable nonionic surfactants are those of the formula $R1(OC_2H_4)nOH$, wherein R1 is a $C_{10}$-$C_{16}$ alkyl group or a $C_8$-$C_{12}$ alkyl phenyl group, and n is from 3 to about 80. In one aspect, particularly useful materials are condensation products of $C_9$-$C_{15}$ alcohols with from about 5 to about 20 moles of ethylene oxide per mole of alcohol.

Additional suitable nonionic surfactants include polyhydroxy fatty acid amides such as N-methyl N-1-deoxyglucityl cocoamide and N-methyl N-1-deoxyglucityl oleamide and alkyl polysaccharides such as the ones described in U.S. Pat. No. 5,332,528. Alkylpolysaccharides disclosed in U.S. Pat. No. 4,565,647.

The fabric care compositions of the present invention may contain up to about 30%, alternatively from about 0.01% to about 20%, more alternatively from about 0.1% to about 20%, by weight of the composition, of a cationic surfactant. For the purposes of the present invention, cationic surfactants include those which can deliver fabric care benefits. Non-limiting examples of useful cationic surfactants include: fatty amines; quaternary ammonium surfactants; and imidazoline quat materials.

In some embodiments, useful cationic surfactants, include those disclosed in U.S. Patent Application number 2005/0164905 A1 and having the general Formula (XIII):

(XIII)

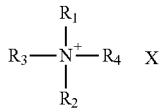

wherein:

(a) $R_1$ and $R_2$ each are individually selected from the groups of: $C_1$-$C_4$ alkyl; $C_1$-$C_4$ hydroxy alkyl; benzyl; —$(CnH_{2n}O)_xH$, wherein:

i. x has a value from about 2 to about 5;

ii. n has a value of about 1-4;

(b) $R_3$ and $R_4$ are each:

i. a $C_8$-$C_{22}$ alkyl; or ii. $R_3$ is a $C_8$-$C_{22}$ alkyl and $R_4$ is selected from the group of: $C_1$-$C_{10}$ alkyl; $C_1$-$C_{10}$ hydroxy alkyl; benzyl; —$(CnH_{2n}O)_xH$, wherein:

1. x has a value from 2 to 5; and 2. n has a value of 1-4; and (c) X is an anion.

Fabric Softening Active Compounds—The fabric softening active may comprise, as the principal active, compounds of the following formula:

$$\{R_{4-m}—N^+—[X—Y—R^1]_m\}X^- \quad \text{(XIV)}$$

wherein each R may comprise either hydrogen, a short chain $C_1$-$C_6$, in one aspect a $C_1$-$C_3$ alkyl or hydroxyalkyl group, for example methyl, ethyl, propyl, hydroxyethyl, and the like, poly($C_{2-3}$ alkoxy), polyethoxy, benzyl, or mixtures thereof; each X may independently be $(CH_2)n$, $CH_2$—$CH(CH_3)$— or CH—$(CH_3)$—$CH_2$—; each Y may comprise —O—(O)C—, —C(O)—O—, —NR—C(O)—, or —C(O)—NR—; each m may be 2 or 3; each n may be from 1 to about 4, in one aspect 2; the sum of carbons in each $R^1$, plus one when Y is —O—(O)C— or —NR—C(O)—, may be $C_{12}$-$C_{22}$, or $C_{14}$-$C_{20}$, with each $R^1$ being a hydrocarbyl, or substituted hydrocarbyl group; and $X^-$ may comprise any softener-compatible anion. In one aspect, the softener-compatible anion may comprise chloride, bromide, methylsulfate, ethylsulfate, sulfate, and nitrate. In another aspect, the softener-compatible anion may comprise chloride or methyl sulfate.

In another aspect, the fabric softening active may comprise the general Formula (XV):

$$[R_3N^+CH_2CH(YR^1)(CH_2YR^1)]X^- \quad \text{Formula (XV)}$$

wherein each Y, R, $R^1$, and $X^-$ have the same meanings as before. Such compounds include those having the Formula (XVI):

$$[CH_3]_3N^{(+)}[CH_2CH(CH_2O(O)CR^1)O(O)CR^1]Cl^{(-)} \quad \text{(XVI)}$$

wherein each R may comprise a methyl or ethyl group. In one aspect, each $R^1$ may comprise a $C_{15}$ to $C_{19}$ group. As used herein, when the diester is specified, it can include the monoester that is present.

These types of agents and general methods of making them are disclosed in U.S. Pat. No. 4,137,180. An example of a suitable DEQA (2) is the "propyl" ester quaternary ammonium fabric softener active comprising the formula 1,2-di (acyloxy)-3-trimethylammoniopropane chloride.

In one aspect, the fabric softening active may comprise the Formula (XVII):

$$[R_{4-m}—N^+—R^1{}_m]X^- \quad \text{(XVII)}$$

wherein each R, $R^1$, m and $X^-$ have the same meanings as before.

In a further aspect, the fabric softening active may comprise the Formula (XVIII):

(XVIII)

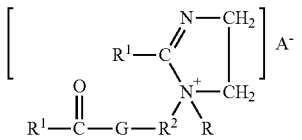

wherein each R and $R^1$ have the definitions given above; $R^2$ may comprise a $C_{1-6}$ alkylene group, in one aspect an ethylene group; and G may comprise an oxygen atom or an —NR— group; and $A^-$ is as defined below.

In a yet further aspect, the fabric softening active may comprise the Formula (XIX):

(XIX)

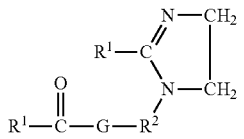

wherein $R^1$, $R^2$ and G are defined as above.

In a further aspect, the fabric softening active may comprise condensation reaction products of fatty acids with dialkylenetriamines in, e.g., a molecular ratio of about 2:1, said reaction products containing compounds of the Formula (XX):

$$R^1—C(O)—NH—R^2—NH—R^3—NH—C(O)—R^1 \quad \text{(XX)}$$

wherein $R^1$, $R^2$ are defined as above, and $R^3$ may comprise a $C_{1-6}$ alkylene group, or an ethylene group and wherein the reaction products may optionally be quaternized by the additional of an alkylating agent such as dimethyl sulfate. Such quaternized reaction products are described in additional detail in U.S. Pat. No. 5,296,622.

In a yet further aspect, the fabric softening active may comprise the Formula (XXI):

$$[R^1—C(O)—NR—R^2—N(R)_2—R^3—NR—C(O)—R^1]^+A^- \quad \text{(XXI)}$$

wherein R, $R^1$, $R^2$ and $R^3$, are defined as above; $A^-$ is as defined below;

In a Yet Further Aspect, the Fabric Softening Active May Comprise Reaction Products of Fatty Acid with hydroxyalkylalkylenediamines in a molecular ratio of about 2:1, said reaction products containing compounds of the Formula (XXII):

$$R^1—C(O)—NH—R^2—N(R^3OH)—C(O)—R^1 \quad \text{(XXII)}$$

wherein $R^1$, $R^2$ and $R^3$ are defined as above;

In a yet further aspect, the fabric softening active may comprise the Formula (XXIII):

(XXIII)

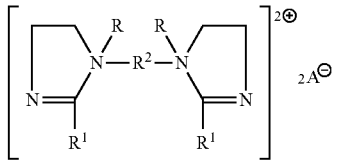

wherein R, $R^1$ and $R^2$ are defined as above; $A^-$ is as defined below.

In yet a further aspect, the fabric softening active may comprise the Formula (XXIV);

Formula (XXIV)

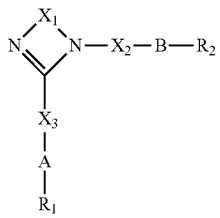

wherein;

$X_1$ may comprise a $C_{2-3}$ alkyl group, in one aspect, an ethyl group;

$X_2$ and $X_3$ may independently comprise $C_{1-6}$ linear or branched alkyl or alkenyl groups, in one aspect, methyl, ethyl or isopropyl groups;

$R_1$ and $R_2$ may independently comprise $C_{8-22}$ linear or branched alkyl or alkenyl groups;

characterized in that;

A and B are independently selected from the group comprising —O—(C═O)—, —(C═O)—O—, or mixtures thereof, in one aspect, —O—(C═O)—.

Non-limiting examples of fabric softening actives comprising Formula (XIV) are N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate.

A non-limiting example of fabric softening actives comprising Formula (XVI) is 1, 2 di (stearoyl-oxy) 3 trimethyl ammoniumpropane chloride.

Non-limiting examples of fabric softening actives comprising Formula (XVII) may include dialkylenedimethylammonium salts such as dicanoladimethylammonium chloride, di(hard)tallowedimethylammonium chloride dicanoladimethylammonium methylsulfate. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of fabric softening actives comprising Formula (XVIII) may include 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of fabric softening actives comprising Formula (XIX) is 1-tallowylamidoethyl-2-tallowylimidazoline wherein $R^1$ may comprise an acyclic aliphatic $C_{15}$-$C_{17}$ hydrocarbon group, $R^2$ may comprise an ethylene group, and G may comprise a NH group.

A non-limiting example of a fabric softening active comprising Formula (XX) is the reaction products of fatty acids with diethylenetriamine in a molecular ratio of about 2:1, said reaction product mixture comprising N,N"-dialkyldiethylenetriamine having the Formula (XXV):

$$R^1—C(O)—NH—CH_2CH_2—NH—CH_2CH_2—NH—C(O)—R^1 \quad \text{Formula (XXV)}$$

wherein $R^1$ is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Compound (XXI) is a difatty amidoamine based softener having the Formula (XXVI):

$$[R^1—C(O)—NH—CH_2CH_2—N(CH_3)(CH_2CH_2OH)—CH_2CH_2—NH—C(O)—R^1]^+CH_3SO_4^- \quad \text{Formula (XXVI)}$$

wherein $R^1$ is an alkyl group. An example of such compound is that commercially available from the Witco Corporation e.g. under the trade name Varisoft® 222LT.

An example of a fabric softening active comprising Formula (XXII) is the reaction products of fatty acids with N-2-hydroxyethylethylenediamine in a molecular ratio of about 2:1, said reaction product mixture comprising the Formula (XXVII):

$$R^1—C(O)—NH—CH_2CH_2—N(CH_2CH_2OH)—C(O)—R^1 \quad \text{Formula (XXVII)}$$

wherein $R^1$—C(O) is an alkyl group of a commercially available fatty acid derived from a vegetable or animal source, such as Emersol® 223LL or Emersol® 7021, available from Henkel Corporation.

An example of a fabric softening active comprising Formula (XXIII) is the diquaternary compound having the Formula (XXVIII):

Formula (XXVIII)

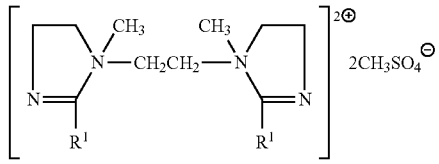

wherein $R^1$ is derived from fatty acid. Such compound is available from Witco Company.

A non-limiting example of a fabric softening active comprising Formula (XXIV) is a dialkyl imidazoline diester compound, where the compound is the reaction product of N-(2-hydroxyethyl)-1,2-ethylenediamine or N-(2-hydroxyisopropyl)-1,2-ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid or a mixture of the above.

It will be understood that combinations of softener actives disclosed above are suitable for use herein.

Anion A

In the cationic nitrogenous salts herein, the anion $A^-$, which comprises any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. In one aspect, the anion A may comprise chloride or methylsulfate. The anion, in some aspects, may carry a double charge. In this aspect, $A^-$ represents half a group.

In one aspect, the fabric care and/or treatment composition may comprise a second softening agent selected from the group consisting of polyglycerol esters (PGEs), oily sugar derivatives, and wax emulsions. Suitable PGEs include those disclosed in U.S. PA 61/089,080. Suitable oily sugar derivatives and wax emulsions include those disclosed in USPA 2008-0234165 A1.

In one aspect, the compositions may comprise from about 0.001% to about 0.01% of an unsaturated aldehyde. In one aspect, the compositions are essentially free of an unsaturated aldehyde. Without being limited by theory, in this aspect, the compositions are less prone to the yellowing effect often encountered with amino-containing agents.

Builders—The compositions may also contain from about 0.1% to 80% by weight of a builder. Compositions in liquid form generally contain from about 1% to 10% by weight of the builder component. Compositions in granular form generally contain from about 1% to 50% by weight of the builder component. Detergent builders are well known in the art and can contain, for example, phosphate salts as well as various organic and inorganic nonphosphorus builders. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. Nos. 4,144,226 and 4,246,495. Other polycarboxylate builders are the oxydisuccinates and the ether carboxylate builder compositions comprising a combination of tartrate monosuccinate and tartrate disuccinate described in U.S. Pat. No. 4,663,071, Builders for use in liquid detergents are described in U.S. Pat. No. 4,284,532, One suitable builder includes may be citric acid. Suitable nonphosphorus, inorganic builders include the silicates, aluminosilicates, borates and carbonates, such as sodium and potassium carbonate, bicarbonate, sesquicarbonate, tetraborate decahydrate, and silicates having a weight ratio of SiO2 to alkali metal oxide of from about 0.5 to about 4.0, or from about 1.0 to about 2.4. Also useful are aluminosilicates including zeolites. Such materials and their use as detergent builders are more fully discussed in U.S. Pat. No. 4,605,509.

Dispersants—The compositions may contain from about 0.1%, to about 10%, by weight of dispersants Suitable water-soluble organic materials are the homo- or co-polymeric acids or their salts, in which the polycarboxylic acid may contain at least two carboxyl radicals separated from each other by not more than two carbon atoms. The dispersants may also be alkoxylated derivatives of polyamines, and/or quaternized derivatives thereof such as those described in U.S. Pat. Nos. 4,597,898, 4,676,921, 4,891,160, 4,659,802 and 4,661,288.

Enzymes—The compositions may contain one or more detergent enzymes which provide cleaning performance and/or fabric care benefits. Examples of suitable enzymes include hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination may be a cocktail of conventional applicable enzymes like protease, lipase, cutinase and/or cellulase in conjunction with amylase. Enzymes can be used at their art-taught levels, for example at levels recommended by suppliers such as Novozymes and Genencor. Typical levels in the compositions are from about 0.0001% to about 5%. When enzymes are present, they can be used at very low levels, e.g., from about 0.001% or lower; or they can be used in heavier-duty laundry detergent formulations at higher levels, e.g., about 0.1% and higher. In accordance with a preference of some consumers for "non-biological" detergents, the compositions may be either or both enzyme-containing and enzyme-free.

Dye Transfer Inhibiting Agents—The compositions may also include from about 0.0001%, from about 0.01%, from about 0.05% by weight of the compositions to about 10%, about 2%, or even about 1% by weight of the compositions of one or more dye transfer inhibiting agents such as polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Chelant—The compositions may contain less than about 5%, or from about 0.01% to about 3% of a chelant such as citrates; nitrogen-containing, P-free aminocarboxylates such as EDDS, EDTA and DTPA; aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems.

Brighteners—The compositions may also comprise a brightener (also referred to as "optical brightener") and may include any compound that exhibits fluorescence, including compounds that absorb UV light and reemit as "blue" visible light. Non-limiting examples of useful brighteners include: derivatives of stilbene or 4,4'-diaminostilbene, biphenyl, five-membered heterocycles such as triazoles, pyrazolines, oxazoles, imidiazoles, etc., or six-membered heterocycles (coumarins, naphthalamide, s-triazine, etc.). Cationic, anionic, nonionic, amphoteric and zwitterionic brighteners can be used. Suitable brighteners include those commercially marketed under the trade name Tinopal-UNPA-GX® by Ciba Specialty Chemicals Corporation (High Point, N.C.).

Bleach system—Bleach systems suitable for use herein contain one or more bleaching agents. Non-limiting examples of suitable bleaching agents include catalytic metal complexes; activated peroxygen sources; bleach activators; bleach boosters; photobleaches; bleaching enzymes; free radical initiators; $H_2O_2$; hypohalite bleaches; peroxygen sources, including perborate and/or percarbonate and combinations thereof. Suitable bleach activators include perhydrolyzable esters and perhydrolyzable imides such as, tetraacetyl ethylene diamine, octanoylcaprolactam, benzoyloxybenzenesulphonate, nonanoyloxybenzene-isulphonate, benzoylvalerolactam, dodecanoyloxybenzenesulphonate. Suitable bleach boosters include those described in U.S. Pat. No. 5,817,614. Other bleaching agents include metal complexes of transitional metals with ligands of defined stability constants. Such catalysts are disclosed in U.S. Pat. Nos. 4,430,243, 5,576,282, 5,597,936 and 5,595,967.

Stabilizer—The compositions may contain one or more stabilizers and thickeners. Any suitable level of stabilizer may be of use; exemplary levels include from about 0.01% to about 20%, from about 0.1% to about 10%, or from about 0.1% to about 3% by weight of the composition. Non-limiting examples of stabilizers suitable for use herein include crystalline, hydroxyl-containing stabilizing agents, trihydroxystearin, hydrogenated oil, or a variation thereof, and combinations thereof. In some aspects, the crystalline, hydroxyl-containing stabilizing agents may be water-insoluble wax-like substances, including fatty acid, fatty ester or fatty soap. In other aspects, the crystalline, hydroxyl-containing stabilizing agents may be derivatives of castor oil, such as hydrogenated castor oil derivatives, for example, castor wax. The hydroxyl containing stabilizers are disclosed in U.S. Pat. Nos. 6,855,680 and 7,294,611. Other stabilizers include thickening stabilizers such as gums and other similar polysaccharides, for example gellan gum, carrageenan gum, and other known types of thickeners and rheological additives. Exemplary stabilizers in this class include gum-type polymers (e.g. xanthan gum), polyvinyl alcohol and derivatives thereof, cellulose and derivatives thereof including cellulose ethers and cellulose esters and tamarind gum (for example, comprising xyloglucan polymers), guar gum, locust bean gum (in some aspects comprising galactomannan polymers), and other industrial gums and polymers.

For the purposes of the present invention, the non-limiting list of adjuncts illustrated hereinafter are suitable for use in the instant compositions and may be desirably incorporated in certain embodiments of the invention, for example to assist or enhance performance, for treatment of the substrate to be cleaned, or to modify the aesthetics of the composition as is the case with perfumes, colorants, dyes or the like. It is understood that such adjuncts are in addition to the components that are supplied via Applicants' perfumes and/or perfume systems. The precise nature of these additional components, and levels of incorporation thereof, will depend on the physical form of the composition and the nature of the operation for which it is to be used. Suitable adjunct materials include, but are not limited to, surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments. In addition to the disclosure below, suitable examples of such other adjuncts and levels of use are found in U.S. Pat. Nos. 5,576,282, 6,306,812 B1 and 6,326,348 B1 that are incorporated by reference.

Silicones—Suitable silicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked. In one aspect, the organosilicones may be linear.

In one aspect, the organosilicone may comprise a non-functionalized siloxane polymer that may have Formula (XXIX) below, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j \quad \text{(Formula XXIX)}$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from about 0 to about 10, or from about 0 to about 4, or 0;

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the names DC 200 Fluid, DC 1664, DC 349, DC 346G available from Dow Corning Corporation, Midland, Mich., and those available under the trade names SF1202, SF1204, SF96, and Viscasil® available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in USPA 2005/0098759, and U.S. Pat. Nos. 4,818,421 and 3,299,112. Exemplary commercially available silicone polyethers include DC 190, DC 193, FF400, all available from Dow Corning Corporation, and various Silwet surfactants available from Momentive Silicones.

In another aspect, the functionalized siloxane polymer may comprise an aminosilicone. Suitable aminosilicones are described in U.S. Pat. Nos. 7,335,630 B2, 4,911,852, and USPA 2005/0170994A1. In one aspect the aminosilicone may be that described in U.S. PA 61/221,632. In another aspect, the aminosilicone may comprise the structure of Formula (XXX):

$$[R_1R_2R_3SiO_{1/2}]_n[(R_4Si(X—Z)O_{2/2}]_k[R_4R_4SiO_{2/2}]_m[R_4SiO_{3/2}]_j \quad \text{(Formula XXX)}$$

wherein i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —$CH_2$—CH(OH)—$CH_2$—; and/or

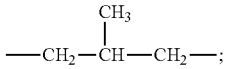

iii. Each Z may be independently selected from —$N(R_5)_2$;

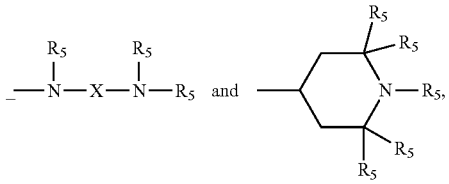

wherein each $R_5$ may be selected independently selected from H, $C_1$-$C_{20}$ alkyl; and $A^-$ may be a compatible anion. In one aspect, $A^-$ may be a halide;

iv. k may be an integer from about 3 to about 20, from about 5 to about 18 more or even from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from about 0 to about 10, or from about 0 to about 4, or 0;

In one aspect, $R_1$ may comprise —OH. In this aspect, the organosilicone is amidomethicone.

Exemplary commercially available aminosilicones include DC 8822, 2-8177, and DC-949, available from Dow Corning Corporation, and KF-873, available from Shin-Etsu Silicones, Akron, Ohio.

In one aspect, the organosilicone may comprise amine ABn silicones and quat ABn silicones. Such organosilicones are generally produced by reacting a diamine with an epoxide. These are described, for example, in U.S. Pat. Nos. 6,903,061 B2, 5,981,681, 5,807,956, 6,903,061 and 7,273,837. These are commercially available under the trade names Magnasoft® Prime, Magnasoft® JSS, Silsoft® A-858 (all from Momentive Silicones).

In another aspect, the functionalized siloxane polymer may comprise silicone-urethanes, such as those described in U.S. PA 61/170,150. These are commercially available from Wacker Silicones under the trade name SLM-21200.

When a sample of organosilicone is analyzed, it is recognized by the skilled artisan that such sample may have, on average, the non-integer indices for Formula (XXIX) and (XXX) above, but that such average indices values will be within the ranges of the indices for Formula (XXIX) and (XXX) above.

Perfume: The optional perfume component may comprise a component selected from the group consisting of (1) a perfume microcapsule, or a moisture-activated perfume microcapsule, comprising a perfume carrier and an encapsulated perfume composition, wherein said perfume carrier may be selected from the group consisting of cyclodextrins, starch microcapsules, porous carrier microcapsules, and mixtures thereof; and wherein said encapsulated perfume composition comprises low volatile perfume ingredients, high volatile perfume ingredients, and mixtures thereof;

(2) a pro-perfume;

(3) a low odor detection threshold perfume ingredients, wherein said low odor detection threshold perfume ingredients may comprise less than about 25%, by weight of the total neat perfume composition; and (4) mixtures thereof; and The weight ratio of the fabric softening active to said carrier component may be from about 1:19 to about 19:1. In one aspect, the fabric conditioning composition exhibits a melting point greater than about 90° C.

Microcapsule—The compositions may comprise from about 0.05% to about 5%; or from about 0.1% to about 1% of a microcapsule. In one aspect, the microcapsule may comprise a shell comprising a polymer crosslinked with an aldehyde. In one aspect, the microcapsule may comprise a shell comprising a polymer selected from the group consisting of polyurea, polyurethane, polyamine, urea crosslinked with an aldehyde or melamine crosslinked with an aldehyde. Examples of materials suitable for making the shell of the microcapsule include melamine-formaldehyde, urea-formaldehyde, phenol-formaldehyde, or other condensation polymers with formaldehyde.

In one aspect, the microcapsules may vary in size (i.e., the maximum diameter is from about 1 to about 75 microns, or from about 5 to about 30 microns). The capsules may have an average shell thickness ranging from about 0.05 to about 10 microns, alternatively from about 0.05 to about 1 micron.

In one aspect, the microcapsule may comprise a perfume microcapsule. In turn, the perfume core may comprise a perfume and optionally a diluent. Suitable perfume microcapsules may include those described in the following references: published USPA Nos 2003-215417 A1; 2003-216488 A1; 2003-158344 A1; 2003-165692 A1; 2004-071742 A1; 2004-071746 A1; 2004-072719 A1; 2004-072720 A1; 2003-203829 A1; 2003-195133 A1; 2004-087477 A1; 2004-0106536 A1; USPNs 6645479; 6200949; 4882220; 4917920; 4514461; RE32713; 4234627; EP 1393706 A1. Capsules having a perfume loading of from about 50% to about 95% by weight of the capsule may be employed.

The shell material surrounding the core to form the microcapsule can be any suitable polymeric material which is impervious or substantially impervious to the materials in the core (generally a liquid core) and the materials which may come in contact with the outer surface of the shell. In one aspect, the material making the shell of the microcapsule may comprise formaldehyde. Formaldehyde based resins such as melamine-formaldehyde or urea-formaldehyde resins are especially attractive for perfume encapsulation due to their wide availability and reasonable cost.

One method for forming shell capsules useful herein is polycondensation, which may be used to produce aminoplast encapsulates. Aminoplast resins are the reaction products of one or more amines with one or more aldehydes, typically formaldehyde. Non-limiting examples of amines are melamine and its derivatives, urea, thiourea, benzoguanamine, and acetoguanamine and combinations of amines. Suitable cross-linking agents (e.g. toluene diisocyanate, divinyl benzene, butane diol diacrylate, etc) may also be used and secondary wall polymers may also be used as appropriate, as described in the art, e.g., anhydrides and their derivatives, particularly polymers and copolymers of maleic anhydride as disclosed in published USPA 2004-0087477 A1.

Microcapsules having the liquid cores and polymer shell walls as described above can be prepared by any conventional process which produces capsules of the requisite size, friability and water-insolubility. Generally, such methods as coacervation and interfacial polymerization can be employed in known manner to produce microcapsules of the desired characteristics. Such methods are described in Ida et al, U.S. Pat. Nos. 3,870,542; 3,415,758; and 3,041,288.

Cyclodextrin. A suitable moisture-activated perfume carrier that may be useful in the disclosed multiple use fabric conditioning composition may comprise cyclodextrin. As used herein, the term "cyclodextrin" includes any of the known cyclodextrins such as unsubstituted cyclodextrins containing from six to twelve glucose units, especially beta-cyclodextrin, gamma-cyclodextrin, alpha-cyclodextrin, and/or derivatives thereof, and/or mixtures thereof. A more detailed description of suitable cyclodextrins is provided in U.S. Pat. No. 5,714,137. Suitable cylodextrins herein include beta-cyclodextrin, gamma-cyclodextrin, alpha-cyclodextrin, substituted beta-cyclodextrins, and mixtures thereof. In one aspect, the cyclodextrin may comprise beta-cyclodextrin. Perfume molecules are encapsulated into the cavity of the cyclodextrin molecules to form molecular microcapsules, commonly referred to as cyclodextrin/perfume complexes. The perfume loading in a cyclodextrin/perfume complex may comprise from about 3% to about 20%, or from about 5% to about 18%, or from about 7% to about 16%, by weight of the cyclodextrin/perfume complex.

The cyclodextrin/perfume complexes hold the encapsulated perfume molecules tightly, so that they can prevent perfume diffusion and/or perfume loss, and thus reducing the odor intensity of the multiple use fabric conditioning composition. However, the cyclodextrin/perfume complex can readily release some perfume molecules in the presence of moisture, thus providing a long lasting perfume benefit. Nonlimiting examples of preparation methods are given in U.S. Pat. Nos. 5,552,378, and 5,348,667.

Suitable cyclodextrin/perfume complexes (or perfume cyclodextrin microcapsule) may have a small particle size, typically from about 0.01 to about 200 micrometer, or from about 0.1 less than about 150 micrometer, or from about 1.0 to about 100 micrometer, or from about 10 to about 50 micrometer.

The multiple use fabric conditioning compositions may comprise of from about 0.1% to about 25%, or from about 1% to about 20%, or from about 3% to about 15%, or from about 5% to about 10%, by weight of the total fabric conditioning composition, of cyclodextrin/perfume complex.

Moisture-Activated Cellular Matrix Microcapsule Moisture-activated and/or water-soluble perfume cellular matrix microcapsules are solid particles containing perfume stably held in the cells within the particles. Details about moisture-activated perfume cellular matrix microcapsules are disclosed in U.S. Pat. No. 3,971,852. A suitable moisture-activated perfume cellular matrix microcapsule may be perfume starch microcapsule which uses starch as the cellular matrix material.

Moisture-activated perfume cellular matrix microcapsules may have a size of from about 0.5 micron to about 300 microns, from about 1 micron to about 200 microns, or from about 2 microns to about 100 microns. The perfume loading in the cellular matrix microcapsules may range from about 20% to about 70%, or from about 40% to about 60%, by weight of the microcapsules. Sufficient amount of perfume moisture-activated microcapsules should be used to deliver the desired levels of perfume, depending on the perfume loading of the microcapsules. For microcapsules with a perfume loading of about 50%, typical level of the matrix microcapsules may comprise from about 0.1% to about 15%, from about 0.5% to about 7%, from about 0.8% to about 8%, or from about 1% to about 6%, by weight of the multiple use fabric conditioning composition.

A dispersing agent may be used to distribute the moisture-activated perfume cellular matrix microcapsules uniformly in the molten multiple use fabric conditioning composition. Suitable dispersing agents for use in combination with moisture-activated cellular microcapsules include block copolymer having blocks of terephthalate and polyethylene oxide. More specifically, these polymers are comprised of repeating units of ethylene and/or propylene terephthalate and polyethylene oxide terephthalate at a molar ratio of poly(ethylene/propylene)terephthalate units to polyethylene oxide terephthalate units of from about 25:75 to about 35:65, said polyethylene oxide terephthalate containing polyethylene oxide blocks having molecular weights of from about 300 to about 2,000. The molecular weight of this polymeric dispersing agent may be in the range of from about 5,000 to about 55,000.

Another suitable dispersing agent for use in combination with moisture-activated cellular microcapsules may be block copolymer having blocks of polyethylene oxide and of polypropylene oxide. Nonlimiting examples of dispersing agent of this type include Pluronic® surfactants and Tetronic® surfactants.

In the process of preparing a multiple use fabric conditioning bar, a suitable dispersing agent may first be added to the fabric conditioning composition melt mixture with mixing, and the moisture-activated perfume starch microcapsules may then be added to the melt mixture with mixing, and the resulting mixture may be poured into a mold to form a multiple use fabric conditioning bar.

Porous Carrier Microcapsule—A portion of the perfume composition can also be absorbed onto and/or into a porous carrier, such as zeolites or clays, to form perfume porous carrier microcapsules in order to reduce the amount of free perfume in the multiple use fabric conditioning composition. When the perfume is to be adsorbed onto zeolite, the perfume ingredients forming the encapsulated perfume composition can be selected according to the description provided in U.S. Pat. No. 5,955,419.

Pro-perfume—The perfume composition may additionally include a pro-perfume. Pro-perfumes may comprise nonvolatile materials that release or convert to a perfume material as a result of, e.g., simple hydrolysis, or may be pH-change-triggered pro-perfumes (e.g. triggered by a pH drop) or may be enzymatically releasable pro-perfumes, or light-triggered pro-perfumes. The pro-perfumes may exhibit varying release rates depending upon the pro-perfume chosen. Pro-perfumes suitable for use in the disclosed compositions are described in the following: U.S. Pat. Nos. 5,378,468; 5,626,852; 5,710,122; 5,716,918; 5,721,202; 5,744,435; 5,756,827; 5,830,835; and 5,919,752.

Processes of Making Fabric and Home Care Compositions

A process of making a fabric and home care product comprising:

a. making an emulsion, wherein said emulsion is an emulsion according to claims 1 to 10, said process comprising the steps of: combining polyolefine, polymer Px, water and optionally oil Ox, surfactant Sx and additives Ax and homogenizing said components in a mechanical mixer without the use of a solvent and b. combining said emulsion with an adjunct to form a fabric and home care product, is disclosed.

The compositions of the present invention can be formulated into any suitable form and prepared by any process chosen by the formulator, non-limiting examples of which are described in U.S. Pat. Nos. 5,879,584; 5,691,297; 5,574,005; 5,569,645; 5,565,422;5,516,448; 5,489,392; 5,486,303 all of which are incorporated herein by reference.

Method of Use and Treated Situs

The fabric and home care products disclosed herein can be used to clean or treat a situs inter alia a surface or fabric. Typically at least a portion of the situs is contacted with an embodiment of Applicants' composition, in neat form or diluted in a liquor, for example, a wash liquor and then the situs may be optionally washed and/or rinsed. In one aspect, a situs is optionally washed and/or rinsed, contacted with a particle according to the present invention or composition comprising said particle and then optionally washed and/or rinsed. For purposes of the present invention, washing includes but is not limited to, scrubbing, and mechanical agitation. The fabric may comprise most any fabric capable of being laundered or treated in normal consumer use conditions. Liquors that may comprise the disclosed compositions may have a pH of from about 3 to about 11.5. Such compositions are typically employed at concentrations of from about 500 ppm to about 15,000 ppm in solution. When the wash solvent is water, the water temperature typically ranges from about 5° C. to about 90° C. and, when the situs comprises a fabric, the water to fabric ratio is typically from about 1:1 to about 30:1.

In addition to the aforementioned methods, a situs treated with any of Applicants fabric and home care compositions is disclosed. In one aspect, such treatment may be achieved by treating a situs in accordance with at least one of the aforementioned methods.

EXAMPLES

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

Examples

Examples 1 to 14

Preparation of Components

Example 1

Preparation of Terpolymer (A1)

206 g polyisobutene with molecular weight $M_n$ of 550 g/mol and 185 g diisobutene are charged into a 4 l stirred vessel and heated to 110° C. under a low flow of nitrogen. After the temperature have reached 110° C., 184 g liquid maleic anhydride (melt of approx. 70° C.) are fed into the reaction over 5 hours and 5.5 g tert.-butyl peroctoate, dissolved in 25 g diisobutene (mixture of 2,4,4-trimethyl-1-pentene and 2,4,4-trimethyl-2-pentene) are fed into the reaction over 5.5 hours. The resulting terpolymer is A1.

Example 2

Preparation of Terpolymer (A2)

The reaction mixture of Example 1 is cooled to 90° C. and 2400 g of water and 140 g aqueous NaOH (50 wt. %) are added at the same time. The mixture is subsequently stirred for 4 hours at 90° C. and then cooled to room temperature. The resulting terpolymer (A2) is received in the form of an aqueous dispersion of pH 6.5, having a water content of 80 wt % and a K-value of 14.7.

Example 3

Preparation of Terpolymer (A3)

In a stirred vessel, 2350 g o-xylene, 1450 g maleic acid anhydride, 64 g polyvinyl ethyl ether (30.00% solution in o-xylene, BASF SE, Ludwigshafen, Germany) and 1470 g polyisobutene (molecular weight 1000 g/mol) are precharged. The vessel is set under nitrogen atmosphere and the pressure is set to approx. 300 mbar. Subsequently, the temperature is set to 110° C. and the pressure is maintained at 300 mbar. Within 5.5 hours, 62.5 g tert.-butylperoctoate in 625 g o-xylene are added to the reaction mixture. 5 min after start of the feed, a second feed of 649 g isobutene is started and dosed within 5 hours. The pressure of the reaction did not exceed 1.5 bar. After the end of the feed, the reaction mixture is stirred for one hour at 110° C. The resulting polymer A3 has a solids content of 51.3% and a K-value of 19.5 (1% in cyclohexanone).

Example 4

Modification of Terpolymer A1 (A4)

To the obtained polymer solution (of A1) in o-xylene 5.2 g of dimethylaminopropylamine in o-xylene (250 ml) are added under stifling at 90° C. over 30 min. After stirring for further 30 min the resulting polymer solution is heated to 150° C. and kept at that temperature for 4 hours. Afterwards the temperature is lowered to 30° C. and a sufficient amount of o-xylene is added to maintain an acceptable viscosity. Then dimethylsulfate (3 g in 15 ml o-xylene) is added over 30 min to the stirred polymer solution. After 30 min at 20° C. the temperature is raised to 90° C. and kept for 1 hour. 500 ml of hot water are added and a water vapor distillation is carried out until all o-xylene have been removed. This resulted in terpolymer A4.

Example 5 (Hypothetical)

Modification of Terpolymer A3 (Ax)

Polymer A3 can be modified in the same way as polymer A1 in Example 4.

Example 6

Preparation of Maleic Anhydride/$C_{12}$ Copolymer

In a 2 l stirred vessel 1120 g $C_{12}$ Olefine is added. This is heated under nitrogen to 150° C. 736 g of maleic anhydride and a solution of 20.4 g di-tert-butylperoxid in 139 g of $C_{12}$ Olefin are added over 6 hours. After the addition is complete, the temperature is kept at 150° C. for another 1 hour. Afterwards the hot molten polymer is transferred into a porcelain plate. After cooling for several hours, the rigid polymer is broken to lumps and powdered.

Example 7

Preparation of Terpolymer A 5

In a 2 l stirred vessel 560 g o-xylene and 399 g of maleic anhydride/$C_{12}$ copolymer are added. This mixture is heated to 90° C. and 7.7 g dimethylaminopropylamine dissolved in 50 g o-xylene are added within 2 h at 90° C. Afterwards the temperature is raised to 100° C. and kept at this temperature for 1 hour. Afterwards the temperature is raised to 150° C. and formed water is distilled off using a Dean Stark condenser for 4 hours. This resulted in terpolymer A5.

Example 8

Modification of Terpolymer A5 (A6)

500 g of terpolymer A5 are placed in a 2 l stirred vessel and cooled to 10° C. 4.3 g of dimethylsulfate are added over 30 min. The temperature is kept below 30° C. After the addition is complete the polymer solution is stirred for 30 min at room temperature before the temperature is raised to 80° C. The o-xylene is removed in vacuum and the resulting polymer is grinded into a powder. This resulting powder is dissolved in 862 g of deionised water and 48.6 g 50% ic sodium hydroxide solution, yielding terpolymer A6.

Example 9

Preparation of Terpolymer A7

In a 2 l stirred vessel 663 g o-xylene and 240 g of powdered MSA/$C_{12}$-polymer are charged and heated to 90° C. 87 g dimethylaminopropylamine are dissolved in 100 g o-xylene and are added over 2 h at 90° C. Then the temperature is raised to 100° C. and kept there for 1 h. Then the temperature is raised to 150° C. and the water is distilled of using a Dean Stark condenser. This yielded a 28.5% ic solution of terpolymer A7.

Example 10 (Hypothetical)

Instead of dimethylaminopropylamine, also other amines such as aminopropylimidazole can be used.

Example 11

Modification of Terpolymer A7 (A8)

650 g of terpolymer A7 are placed in a 21 stirred vessel and cooled to 10° C. Over 30 min 58 g of dimethylsulfate are added and the temperature is kept under 30° C. After the addition is complete the solution is stirred at room temperature for 15 min and then heated to 80° C. This temperature is kept with stirring for 2 h. The solvent is removed by vacuum and the resulting polymer is dissolved in 973 g of deionized water to yield polymer A8.

Example 12

Preparation of Quaternized PIB-DMAPA Imide (PIBSA/DMAPA, Quaternized with Styrene Oxide)

Polyisobutene succinic anhydride (PIBSA) (141 g, 0.1 mol) was dissolved at room temperature in tetrahydrofuran (50 g). While cooling, dimethylamino propylamine (DMAPA) (11 g, 0.1 mol) was added within 15 min. The reaction mixture was stirred for 3 hours. Subsequently, styrene oxide (13 g, 0.1 mol) was added and the temperature was increased to 50° C. After 15 h, the solvent was removed at 50° C./lmbar. The product was formed with 95% yield.

The reaction can be performed in a similar way also in other non-polar solvents like benzene, toluene, diethylether, dichloromethane. Also other quaternization agents can be used, like dimethylsulfate, ethylene oxide, propylene oxide or methyl chloride.

Example 13

Alkoxylated PIB-TEPA Imide (PIBSA/TEPA)/EO5

13 a) (Imide from Polyisobutensuccinic Acid Anhydride and Tetraethylene Pentamine)+1 Mol EO/NH In 2.5 l autoclave a reaction product from polyisobutensuccinic acid anhydride and tetraethylene pentamine (TEPA, 405 g) and water (20 g) were heated to 80° C., and purged three times with nitrogen up to a pressure of 1 bar. After the temperature had been increased to 120° C., ethylene oxide (65.2 g) was added within 20 minutes. To complete the reaction, the mixture was allowed to post-react for 10 h at 120° C. The reaction mixture was stripped with nitrogen and volatile compounds were removed in vacuo at 70° C. 485 g of a brown viscous oil were obtained.

13 b) (Imide from Polyisobutensuccinic Acid Anhydride and Tetraethylene Pentamine)+5 Mole EO/NH The product obtained from Example 13 a) (158 g) and potassium-t-butylat (2.1 g) were heated to 80° C. and purged three times with nitrogen up to a pressure of 1 bar. The mixture was dewatered at 120° C. and a vacuum of 10 mbar for 2 h. After the vacuum had been removed with nitrogen, the temperature had been increased to 130° C. and ethylene oxide (64.2 g) was added. To complete the reaction, the mixture was allowed to post-react for 10 h at 130° C. After decompression the reaction mixture was stripped with nitrogen and volatile compounds were removed in vacuo at 70° C.

215 g of a polyisobutensuccinic acid anhydride-tetraethylene-pentamine adduct with 5 mole EO/NH were obtained as a yellow-brown highly viscous oil.

Example 14

Quaternized Alkoxylated PIB-TEPA Imide 14 a) (Imide from Polyisobutensuccinic Acid Anhydride and Tetraethylene Pentamine)+15 Mole EO/NH The product obtained from Example 14 1 a) (173 g) and potassium-t-butylat (4.0 g) were heated to 80° C. and purged three times with nitrogen up to a pressure of 1 bar. The mixture was dewatered at 120° C. and a vacuum of 10 mbar for 2 h. After the vacuum had been removed with nitrogen, the temperature had been increased to 130° C. and ethylene oxide (247.4 g) were added within 5 hours. To complete the reaction, the mixture was allowed to post-react for 10 h at 130° C. After decompression the reaction mixture was stripped with nitrogen and volatile compounds were removed in vacuo at 70° C.

446 g of a polyisobutensuccinic acid anhydride-tetraethylene-pentamine adduct with 15.2 mole EO/NH were obtained as a yellow-brown highly viscous oil (amine value 0.89 mmol/g)

14 b) (Imide from Polyisobutensuccinic Acid Anhydride and Tetraethylene Pentamine)+15 Mole EO/NH Quaternized with Dimethylsulfate The product obtained from Example 14 a) (100.0 g) was placed in a reaction vessel at 70° C. and a stream of nitrogen was bubbled through the material. Dimethyl sulfate (12.06 g) was added dropwise at 70-75° C. To complete the reaction, the mixture was stirred for 2 h at 75° C. After removal of volatile compounds in vacuo, 96 g of a brown solid (amine value 0.08 mmol/g, degree of quaternization 91.0%) were isolated.

Examples 15 to 26

Preparation of Emulsions

Example 15

Emulsion with Low Non-Ionic Surfactant Level and 20% PIB-Oil Phase

Polyisobutene (PIB) (molecular weight 1000 g/mol) (8.8 parts per weight), PIBSA (1.2 parts per weight) and mineral oil (10.0 parts per weight) are weighed into a container and heated at 80° C. for 30 minutes without stifling. Separately, nonionic surfactant C13-Oxoalcohol+3 EO (HLB 9, 1.0 parts per weight) and nonionic surfactant C13-Oxoalcohol+8 EO (HLB 13, 1.0 parts per weight) are added to de-ionized water (78.0 parts per weight) and heated at 80° C. for 30 minutes, after which time the aqueous mixture is added to the PIB mixture and mixed with an Ultraturrax equipped with shear-head T50 for a total of 2 minutes. The mixing speed is initially set to 5000 rpm and slowly increased to reach 10000 rpm after 2 minutes. Directly afterwards, the mixture is run 6 times through a high pressure homogenizer at 80° C. and 800 bar.

Example 16

Emulsion with Low Non-Ionic Surfactant Level and 35% PIB-Oil Phase

Polyisobutene (PIB) (molecular weight 1000 g/mol) (15.4 parts per weight), PIBSA (2.1 parts per weight) and mineral oil (17.5 parts per weight) are weighed into a container and heated at 80° C. for 30 minutes without stifling. Separately, nonionic surfactant C13-Oxoalcohol+3 EO (HLB 9, 1.75 parts per weight) and nonionic surfactant C13-Oxoalcohol+8 EO (HLB 13, 1.75 parts per weight) are added to de-ionized water (61.5 parts per weight) and heated at 80° C. for 30 minutes, after which time the aqueous mixture is added to the PIB mixture and mixed with an Ultraturrax equipped with shear-head T50 for a total of 2 minutes. The mixing speed is initially set to 5000 rpm and slowly increased to reach 1000 rpm after 2 minutes. No use of high pressure homogenizer is required.

Example 17

Emulsion with Non-Ionic Surfactant and No Mineral Oil

Polyisobutene (molecular weight 1000 g/mol) (28.8 parts per weight), nonionic surfactant C10-Guerbetalcohol+4 EO (HLB 10.5, 2.6 parts per weight), nonionic surfactant C10-Guerbetalcohol+14 EO (HLB 16, 2.6 parts per weight), and PIBSA (2.6 parts per weight) are given into a container and heated at 80° C. for 30 minutes without stirring. Afterwards the sample is mixed with an Ultraturrax equipped with shear-head T50, initially at 500 to 1000 rpm. De-ionized water, which have been preheated to 80° C., is added drop-wise until the water content is finally 63.4 parts per weight. As more water is added the speed of the mixer is gradually increased to 5000 rpm.

Example 18

Emulsion with High Non-Ionic Surfactant Level

Polyisobutene (PIB) (molecular weight 1000 g/mol) (16.4 parts per weight) and PIBSA (1.8 parts per weight) are mixed at about 50° C. Paraffin oil (18.2 parts per weight) is added and the mixture heated to 80° C.

Nonionic surfactant C10-Guerbetalcohol alkoxylate (HLB 12.5, 9.1 parts per weight) is mixed with de-ionized water (54.5 parts per weight) and heated to 80° C. as well.

The PIB/paraffin oil mixture is placed in a heated beaker and fitted with the Ultraturrax equipped with shear-head T25 and the speed is set to 15000 rpm. At 80° C. the mixture of water and non-ionic surfactant is added and treated at this shear rate for 120 sec without further heating.

Example 19

Emulsion with Low Non-Ionic Surfactant Level

Polyisobutene (PIB) (molecular weight 1000 g/mol) (8.8 parts per weight) and PIBSA (1.2 parts per weight) are mixed at approx. 50° C. Paraffin oil (10.0 parts per weight) is added and the mixture is heated to 80° C.

C13-Oxoalcohol+3 EO (HLB 9, 1.0 parts per weight) and nonionic surfactant C13-Oxoalcohol+8 EO (HLB 13, 1.0 parts per weight) are mixed with de-ionized water (78 parts per weight) and heated to 80° C. as well.

The PIB/paraffin oil mixture is placed in a heated beaker and fitted with the Ultraturrax equipped with shear-head T50 and the speed is set to 5000 to 6000 rpm. At 80° C. the mixture of water and non-ionic surfactant is added and treated at this shear rate for 120 sec without further heating.

Example 20

Emulsion with Low Non-Ionic Surfactant Level without Paraffin Oil

Polyisobutene (PIB) (molecular weight 1000 g/mol) (20 parts per weight) and PIBSA (2.2 parts per weight) are mixed at about 50° C. and heated to 80° C.

Nonionic surfactant C10-Guerbetalcohol alkoxylate (HLB 12.5, 11.2 parts per weight) is mixed with de-ionized water (66.6 parts per weight) and heated to 80° C. as well. The PIB mixture is placed in a heated beaker and fitted with the Ultraturrax equipped with shear-head T50 and the speed is set to 5000 to 6000 rpm. At 80° C. the mixture of water and non-ionic surfactant is added and treated at this shear rate for 120 sec without further heating.

Example 21

Emulsion with PIBA (Polyisobuteneamine) as Emulsion Aid and High Non-Ionic Surfactant Level Polyisobutene (PIB) (molecular weight 1000 g/mol) (16.4 parts per weight) and PIBA (1.8 part per weight) are mixed at about 50° C. Paraffin oil (18.2 parts per weight) is added and the mixture is heated to 80° C.

Nonionic surfactant C10-Guerbetalcohol alkoxylate (HLB 12.5, 9.1 parts per weight) is mixed with de-ionized water (54.5 parts per weight) and heated to 80° C. as well. The PIB/paraffin oil mixture is placed in a heated beaker and fitted with the Ultraturrax equipped with shear-head T50 and the speed is set to 5000 to 6000 rpm. At 80° C. the mixture of water and non-ionic surfactant is added and treated at this shear rate for 120 sec without further heating.

Example 22

Emulsion with PIBA as Emulsion Aid and Low Non-Ionic Surfactant Level

Polyisobutene (PIB) (molecular weight 1000 gμmol) (17.3 parts per weight) and PIBA (1.9 parts per weight) are mixed at about 50° C. Paraffin oil (19.2 parts per weight) is added and the mixture heated to 80° C.

Nonionic surfactant C13-Oxoalcohol+3 EO (HLB 9, 1.9 parts per weight) and nonionic surfactant C13-Oxoalcohol+8

EO (HLB 13, 1.9 parts per weight) are mixed with de-ionized water (57.8 parts per weight) and heated to 80° C. as well. The PIB/paraffin oil mixture is placed in a heated beaker and fitted with the Ultraturrax equipped with shear-head T50 and the speed is set to 5000 to 6000 rpm. At 80° C. the mixture of water and non-ionic surfactant is added and treated at this shear rate for 120 sec without further heating.

Example 23

Emulsion with Ethylene/DMAEMA-Wax as Emulsion Aid

Polyisobutene (molecular weight 1000 g/mol) (16.4 parts per weight) and ethylene/DMAEMA wax (1.8 part per weight) are mixed at about 50° C. Paraffin oil (18.2 parts per weight) is added and the mixture is heated to 80° C.

Nonionic surfactant C10-Guerbetalcohol alkoxylate (HLB 12.5, 9 parts per weight) is mixed with de-ionized water (54.6 parts per weight) and heated to 80° C. as well. The PIB/paraffin oil mixture is placed in a heated beaker and fitted with the Ultraturrax equipped with shear-head T50 and the speed is set to 5000 to 6000 rpm. At 80° C. the mixture of water and non-ionic surfactant is added and treated at this shear rate for 120 sec without further heating.

Example 24

Emulsion with Alkoxylated PIB-TEPA Imide (PIBSA/TEPA)/E05 as Emulsion Aid

Polyisobutene (PIB) (molecular weight 1000 g/mol) (16.4 parts per weight) and alkoxylated PIB-TEPA Imide (PIBSA/TEPA)/EO5 (1.9 parts per weight) were mixed at about 50° C. Paraffin oil (18.2 parts per weight) was added and the mixture heated to 80° C.

Nonionic surfactant C10-Guerbetalcohol alkoxylate (HLB 12.5, 9.1 parts per weight) was mixed with de-ionized water (54.5 parts per weight) and heated to 80° C. as well.

The PIB/paraffin oil mixture was placed in a heated beaker and fitted with the Ultraturrax equipped with shear-head T50 and the speed was set to 5000 to 6000 rpm. At 80° C. the mixture of water and non-ionic surfactant was added and treated at this shear rate for 120 sec without further heating.

Example 25

Emulsion with Quaternized Alkoxylated PIB-TEPA Imide (PIBSA/TEPA)/EO15 (91% quat. with DMS) as Emulsion Aid Polyisobutene (PIB) (molecular weight 1000 g/mol) (16.4 parts per weight) and quaternized alkoxylated PIB-TEPA Imide (PIBSA/TEPA)/EO15 (91% quat. with DMS) (1.8 parts per weight) were mixed at about 50° C. Paraffin oil (18.2 parts per weight) was added and the mixture heated to 80° C.

Nonionic surfactant C10-Guerbetalcohol alkoxylate (HLB 12.5, 9.1 parts per weight) was mixed with de-ionized water (54.5 parts per weight) and heated to 80° C. as well.

The PIB/paraffin oil mixture was placed in a heated beaker and fitted with the Ultraturrax equipped with shear-head T50 and the speed was set to 5000 to 6000 rpm. At 80° C. the mixture of water and non-ionic surfactant was added and treated at this shear rate for 120 sec without further heating.

Example 26

Emulsion with Quaternized PIB-DMAPA Imide (PIBSA/DMAPA, quat. with Styrene Oxide) as Emulsion Aid Polyisobutene (PIB) (molecular weight 1000 g/mol) (16.4 parts per weight) and quaternized PIB-DMAPA Imide (PIBSA/DMAPA, quat. with Styrene Oxide) (1.8 parts per weight) were mixed at about 50° C. Paraffin oil (18.2 parts per weight) was added and the mixture heated to 80° C. Nonionic surfactant C10-Guerbetalcohol alkoxylate (HLB 12.5, 9.1 parts per weight) was mixed with de-ionized water (54.5 parts per weight) and heated to 80° C. as well.

The PIB/paraffin oil mixture was placed in a heated beaker and fitted with the Ultraturrax equipped with shear-head T50 and the speed was set to 5000 to 6000 rpm. At 80° C. the mixture of water and non-ionic surfactant was added and treated at this shear rate for 120 sec without further heating.

Example 27

Liquid Detergent Fabric Care Compositions

Liquid detergent fabric care composition 27A is made by mixing together the ingredients listed in the proportions shown and compositions 27B-27E are made by mixing together the ingredients listed in the proportions shown:

| Ingredient (wt %) | 27A | 27B | 27C | 27D | 27E |
|---|---|---|---|---|---|
| $C_{12}$-$C_{15}$ alkyl polyethoxylate (1.8) sulfate[1] | 20.1 | 16.6 | 14.7 | 13.9 | 8.2 |
| $C_{11.8}$ linear alkylbenzene sulfonc acid[2] | — | 4.9 | 4.3 | 4.1 | 8.2 |
| $C_{16}$-$C_{17}$ branched alkyl sulfate[1] | — | 2.0 | 1.8 | 1.6 | — |
| $C_{12}$ alkyl trimethyl ammonium chloride[4] | 2.0 | | — | — | — |
| $C_{12}$ alkyl dimethyl amine oxide[5] | | 0.7 | 0.6 | — | — |
| $C_{12}$-$C_{14}$ alcohol 9 ethoxylate[3] | 0.3 | 0.8 | 0.9 | 0.6 | 0.7 |
| $C_{15}$-$C_{16}$ branched alcohol-7 ethoxylate[1] | — | — | — | — | 4.6 |
| 1,2 Propane diol[6] | 4.5 | 4.0 | 3.9 | 3.1 | 2.3 |
| Ethanol | 3.4 | 2.3 | 2.0 | 1.9 | 1.2 |
| $C_{12}$-$C_{18}$ Fatty Acid[5] | 2.1 | 1.7 | 1.5 | 1.4 | 3.2 |
| Citric acid[7] | 3.4 | 3.2 | 3.5 | 2.7 | 3.9 |
| Protease[7] (32 g/L) | 0.42 | 1.3 | 0.07 | 0.5 | 1.12 |

-continued

| Ingredient (wt %) | 27A | 27B | 27C | 27D | 27E |
|---|---|---|---|---|---|
| Fluorescent Whitening Agent[8] | 0.08 | 0.2 | 0.2 | 0.17 | 0.18 |
| Diethylenetriamine pentaacetic acid[6] | 0.5 | 0.3 | 0.3 | 0.3 | 0.2 |
| Ethoxylated polyamine[9] | 0.7 | 1.8 | 1.5 | 2.0 | 1.9 |
| Grease Cleaning Alkoxylated Polyalkylenimine Polymer[10] | — | — | 1.3 | 1.8 | — |
| Zwitterionic ethoxylated quaternized sulfated hexamethylene diamine[11] | — | 1.5 | — | — | 0.8 |
| Hydrogenated castor oil[12] | 0.2 | 0.2 | | 0.12 | 0.3 |
| Copolymer of acrylamide and methacrylamidopropyl trimethylammonium chloride[13] | 0.3 | 0.2 | 0.3 | 0.1 | 0.3 |
| Polyolefin Emulsion of any of Examples 13-21 (mixtures thereof may also be used)[16] | 6.0 | 6.0 | 3.0 | 0.5 | 3.0 |
| Water, perfumes, dyes, buffers, solvents and other optional components | to 100% pH 8.0-8.2 | to 100% pH 8.0-8.2 | to 100% pH 8.0-8.2 | to 100% pH 8.0-8.2 | to 100% pH 8.0-8.2 |

Example 28

Liquid or Gel Detergents

Liquid or gel detergent fabric care compositions are prepared by mixing the ingredients listed in the proportions shown:

| Ingredient (wt %) | 28A | 28B | 28C | 28D | 28E |
|---|---|---|---|---|---|
| $C_{12}$-$C_{15}$ alkyl polyethoxylate (3.0) sulfate[1] | 8.5 | 2.9 | 2.9 | 2.9 | 6.8 |
| $C_{11.8}$ linear alkylbenzene sulfonic acid[2] | 11.4 | 8.2 | 8.2 | 8.2 | 1.2 |
| $C_{14}$-$C_{15}$ alkyl 7-ethoxylate[1] | — | 5.4 | 5.4 | 5.4 | 3.0 |
| $C_{12}$-$C_{14}$ alkyl 7-ethoxylate[3] | 7.6 | — | — | — | 1.0 |
| 1,2 Propane diol | 6.0 | 1.3 | 1.3 | 6.0 | 0.2 |
| Ethanol | — | 1.3 | 1.3 | — | 1.4 |
| Di Ethylene Glycol | 4.0 | — | — | — | — |
| Na Cumene Sulfonate | — | 1.0 | 1.0 | 0.9 | — |
| $C_{12}$-$C_{18}$ Fatty Acid[5] | 9.5 | 3.5 | 3.5 | 3.5 | 4.5 |
| Citric acid | 2.8 | 3.4 | 3.4 | 3.4 | 2.4 |
| Protease (40.6 mg/g/)[7] | 1.0 | 0.6 | 0.6 | 0.6 | 0.3 |
| Natalase 200L (29.26 mg/g)[14] | — | 0.1 | 0.1 | 0.1 | — |
| Termamyl Ultra (25.1 mg/g)[14] | 0.7 | 0.1 | 0.1 | 0.1 | 0.1 |
| Mannaway 25L (25 mg/g)[14] | 0.1 | 0.1 | 0.1 | 0.1 | 0.02 |
| Whitezyme (20 mg/g)[14] | 0.2 | 0.1 | 0.1 | 0.1 | — |
| Fluorescent Whitening Agent[8] | 0.2 | 0.1 | 0.1 | 0.1 | — |
| Diethylene Triamine Penta Methylene Phosphonic acid | — | 0.3 | 0.3 | 0.3 | 0.1 |
| Hydroxy Ethylidene 1,1 Di Phosphonic acid | 1.5 | — | — | — | — |
| Zwitterionic ethoxylated quaternized sulfated hexamethylene diamine[11] | 2.1 | 1.0 | 1.0 | 1.0 | 0.7 |
| Grease Cleaning Alkoxylated Polyalkylenimine Polymer[10] | — | 0.4 | 0.4 | 0.4 | — |
| PEG-PVAc Polymer[15] | 0.9 | 0.5 | 0.5 | 0.5 | — |
| Hydrogenated castor oil[12] | 0.8 | 0.4 | 0.4 | 0.4 | 0.3 |
| Terpolymer of acrylamide, acrylic acid and methacrylamidopropyl trimethylammonium chloride[13] | — | 0.2 | 0.2 | 0.2 | 0.2 |
| Borate | — | 1.3 | — | — | 1.2 |
| 4 Formyl Phenyl Boronic Acid | — | — | 0.025 | — | — |

-continued

| Ingredient (wt %) | 28A | 28B | 28C | 28D | 28E |
|---|---|---|---|---|---|
| Polyolefin Emulsion of any of Examples 13-21 (mixtures thereof may also be used)[16] | 3.0 | 4.5 | 2.0 | 3.0 | 4.5 |
| Water, perfumes, dyes, buffers, neutralizers, stabilizers and other optional components | to 100% pH 8.0-8.2 | to 100% pH 8.0-8.2 | to 100% pH 8.0-8.2 | to 100% pH 8.0-8.2 | to 100% pH 8.0-8.2 |

[1]Available from Shell Chemicals, Houston, TX.
[2]Available from Huntsman Chemicals, Salt Lake City, UT.
[3]Available from Sasol Chemicals, Johannesburg, South Africa
[4]Available from Evonik Corporation, Hopewell, VA.
[5]Available from The Procter & Gamble Company, Cincinnati, OH.
[6]Available from Sigma Aldrich chemicals, Milwaukee, WI
[7]Available from Genencor International, South San Francisco, CA.
[8]Available from Ciba Specialty Chemicals, High Point, NC
[9]600 g/mol molecular weight polyethylenimine core with 20 ethoxylate groups per —NH and available from BASF (Ludwigshafen, Germany)
[10]600 g/mol molecular weight polyethylenimine core with 24 ethoxylate groups per —NH and 16 propoxylate groups per —NH. Available from BASF (Ludwigshafen, Germany).
[11]Described in U.S. Pat. No. 6,673,890 B1 and available from BASF (Ludwigshafen, Germany)
[12]Available under the tradename Thixin$^R$ from Elementis Specialties, Highstown, NJ
[13]Available from Nalco Chemicals, Naperville, IL.
[14]Available from Novozymes, Copenhagen, Denmark.
[15]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).
[16]incorporated in the formula on the basis of wt % of polyolefine polymer

Example 29

Liquid Detergent Fabric Care Compositions

Liquid detergent fabric care composition 29A is made by mixing together the ingredients listed in the proportions shown and compositions 29B-29D are made by mixing together the ingredients listed in the proportions shown:

| Ingredient | 29A | 29B | 29C | 29D |
|---|---|---|---|---|
| Fabric Softener Active[1] | 16.2 | 11.0 | 16.2 | — |
| Fabric Softener Active[2] | — | — | — | 5.0 |
| Cationic Starch[3] | 1.5 | — | 1.5 | — |
| Polyethylene imine[4] | 0.25 | 0.25 | — | — |
| Quaternized polyacrylamide[5] | — | | 0.25 | 0.25 |
| Calcium chloride | 0.15 | 0. | 0.15 | — |
| Ammonium chloride | 0.1 | 0.1 | 0.1 | — |
| Suds Suppressor[6] | — | — | — | 0.1 |
| Polyolefin Emulsion of any of Examples 13-21 (mixtures thereof may also be used)[7] | 2.0 | 5.0 | 2.0 | 2.0 |
| Perfume | 0.85 | 2.0 | 0.85 | 1.0 |
| Perfume microcapsule[8] | 0.65 | 0.75 | 0.65 | 0.3 |
| Water, suds suppressor, stabilizers, pH control agents, buffers, dyes & other optional ingredients | to 100% pH = 3.0 | to 100% pH = 3.0 | to 100% pH = 3.0 | to 100% pH = 3.0 |

[1]N,N di(tallowoyloxyethyl)-N,N dimethylammonium chloride available from Evonik Corporation, Hopewell, VA.
[2]Reaction product of fatty acid with Methyldiethanolamine, quaternized with Methylchloride, resulting in a 2.5:1 molar mixture of N,N-di(tallowoyloxyethyl) N,N-dimethylammonium chloride and N-(tallowoyloxyethyl) N-hydroxyethyl N,N-dimethylammonium chloride available from Evonik Corporation, Hopewell, VA.
[3]Cationic starch based on common maize starch or potato starch, containing 25% to 95% amylose and a degree of substitution of from 0.02 to 0.09, and having a viscosity measured as Water Fluidity having a value from 50 to 84. Available from National Starch, Bridgewater, NJ
[4]Available from Nippon Shokubai Company, Tokyo, Japan under the trade name Epomin 1050.
[5]Cationic polyacrylamide polymer such as a copolymer of acrylamide/[2-(acryloylamino)ethyl]tri-methylammonium chloride (quaternized dimethyl aminoethylacrylate) available from BASF, AG, Ludwigshafen under the trade name Sedipur 544.
[6]SILFOAM ® SE90 available from Wacker AG of Munich, Germany
[7]Incorporated in the formula based on 100% basis
[8]Available from Appleton Paper of Appleton, WI The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising:

a) an emulsion comprising, based on the total mass of the emulsion, i) from about 2% to about 75% of a polyisobutene;

ii) from about 0.05% to about 40% of a polyisobutene succinic anhydride;

iii) from 0.1% to about 25% of an oil $O_x$;

iv) from 0.1% to about 25% of a surfactant $S_x$;

v) from 0.1% to about 20% of a additive $A_x$; and vi) from about 10% to about 97.95% water;

b) an adjunct ingredient, said composition being a fabric and home care product.

2. A composition according to claim 1, wherein the components of said emulsion are, independently of each other, present in amounts of:

i) from about 5% to about 50% of a polyisobutene;

ii) from about 0.5% to about 30% of a polyisobutene succinic anhydride;

iii) from about 0.1% to about 25% of an oil $O_x$;

iv) from about 0.1% to about 20% of a surfactant $S_x$;

v) from about 0.1% to about 15% of a additive $A_x$; and vi) from about 30% to about 90% water;

based on the total mass of the emulsion.

3. The composition according to claim 2, wherein the components of said emulsion are, independently of each other, present in amounts of:

i) from about 10% to about 40% of a polyisobutene;

ii) from about 0.5% to about 15% of a polyisobutene succinic anhydride;

iii) from about 5% to about 20% of an oil $O_x$;

iv) from about 0.1% to about 15% of a surfactant $S_x$;

v) from about 0.1% to about 10% of a additive $A_x$; and vi) from about 40% to about 85% water;

based on the total mass of the emulsion.

4. The composition of claim 3, wherein the components of said emulsion are, independently of each other, present in amounts of:

i) from about 15% to about 30% of a polyisobutene;

ii) from about 0.5% to about 5% of a polyisobutene succinic anhydride;

iii) from about 10% to about 20% of an oil $O_x$;

iv) from about 0.5% to about 10% of a surfactant $S_x$;

v) from about 2% to about 8% of a additive $A_x$; and vi) from about 50% to about 80% water based on the total mass of the emulsion.

5. A composition according to claim 1, wherein said oil $O_x$ is selected from the group consisting of:

c1) mineral oils, having a boiling point at atmospheric pressure of 150° C. or higher;

c2) esters of $C_{10}$- to $C_{26}$-carboxylic acid with $C_8$ -$C_{24}$-alcohols;

c3) silicone oils; and mixtures thereof.

6. A composition according to claim 1, wherein said surfactant $S_x$ is selected from the group consisting of:

d1) nonionic surfactants;

d2) anionic surfactants;

d3) cationic surfactants; and mixtures thereof.

7. A composition according to claim 1, wherein said emulsion has a content of organic solvent below 50 mg/kg of emulsion.

8. A composition according to claim 1, wherein said emulsion is stable for more than 2 days according to the phase-stability-test.

9. A method of cleaning and/or treating comprising:

a) optionally rinsing and/or washing a situs b) contacting said situs with the composition of any of claims 1-4, 5-8 and mixtures thereof; and c) optionally rinsing and/or washing a situs.

10. A situs treated and/or cleaned with a composition according to any of claims 1-4, 5-8 and mixtures thereof.

11. A process of making a fabric and home care product comprising:

a. making an emulsion, wherein said emulsion is an emulsion as in any of claim 1-4 or 5-8, said process comprising the steps of: combining a polyisobutene, polyisobutene succinic anhydride, water, an oil Ox, a surfactant Sx and an additive Ax and homogenizing said components in a mechanical mixer without the use of a solvent and b. combining said emulsion with an adjunct to form a fabric and home care product.

* * * * *